US009689145B1

(12) United States Patent
Fujii et al.

(10) Patent No.: US 9,689,145 B1
(45) Date of Patent: Jun. 27, 2017

(54) WORK VEHICLE AND METHOD FOR OBTAINING TILT ANGLE

(71) Applicant: KOMATSU LTD., Tokyo (JP)

(72) Inventors: Yuto Fujii, Hirakata (JP); Tsutomu Iwamura, Yokohama (JP); Daiki Arimatsu, Hiratsuka (JP); Katsuhiro Ikegami, Hiratsuka (JP); Masanobu Seki, Fujisawa (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 15/100,720

(22) PCT Filed: Dec. 9, 2015

(86) PCT No.: PCT/JP2015/084472
§ 371 (c)(1),
(2) Date: Jun. 1, 2016

(87) PCT Pub. No.: WO2016/076444
PCT Pub. Date: May 19, 2016

(51) Int. Cl.
*E02F 9/26* (2006.01)
*E02F 3/32* (2006.01)

(52) U.S. Cl.
CPC ..... *E02F 9/264* (2013.01); *E02F 3/32* (2013.01)

(58) Field of Classification Search
CPC . E02F 3/3681; E02F 3/40; E02F 9/265; E02F 9/264; E02F 3/32; G01C 5/12; G01S 19/45
See application file for complete search history.

(56) References Cited

U.S. PATENT DOCUMENTS 4,844,685 A * 7/1989 Sagaser ..... E02F 3/43 414/699
2009/0244106 A1 10/2009 Kuwae et al.
2010/0095720 A1 4/2010 Howarth
(Continued)

FOREIGN PATENT DOCUMENTS

CN 103857854 A 6/2014
JP 3019505 U 10/1995
JP 8-177073 A 7/1996
(Continued)

OTHER PUBLICATIONS

The International Search Report for the corresponding international application No. PCT/JP2015/084472, issued on Feb. 23, 2016.
(Continued)

*Primary Examiner* — Anne M Antonucci
(74) *Attorney, Agent, or Firm* — Global IP Counselors, LLP

(57) ABSTRACT

A hydraulic excavator is provided with a tilt cylinder disposition data creating unit and a bucket information computing unit. The tilt cylinder disposition data creating unit creates tilt cylinder disposition data which indicates that a disposition of a tilt cylinder is either a first disposition in which a bucket is rotated in the clockwise direction due to extension or a second disposition in which the bucket is rotated in the clockwise direction due to contraction, when viewing the bucket from a vehicle body side. The bucket information computing unit obtains a tilt angle of the bucket based on the stroke length on the basis of the tilt cylinder disposition data.

9 Claims, 17 Drawing Sheets

(56) References Cited

U.S. PATENT DOCUMENTS

| | | | |
|---|---|---|---|
| 2014/0100744 | A1 | 4/2014 | Johnson et al. |
| 2015/0345114 | A1 | 12/2015 | Nomura et al. |

FOREIGN PATENT DOCUMENTS

| | | | |
|---|---|---|---|
| JP | 2000-273892 | A | 10/2000 |
| JP | 2009-234366 | A | 10/2009 |
| JP | 2010-521598 | A | 6/2010 |
| JP | 2014-55407 | A | 3/2014 |
| JP | 2014-74319 | A | 4/2014 |

OTHER PUBLICATIONS

The Chinese Office Action for the corresponding Chinese application No. 201580002484.6, issued on May 16, 2017.

* cited by examiner

WORK VEHICLE AND METHOD FOR OBTAINING TILT ANGLE

CROSS-REFERENCE TO RELATED APPLICATIONS

This application is a U.S. National stage application of International Application No. PCT/JP2015/084472, filed on Dec. 9, 2015.

BACKGROUND

Field of the Invention

The present invention relates to a work vehicle and a method for obtaining a tilt angle.

Background Information

A work vehicle provided with a tiltable bucket that is able to rotate about the center of a tilt axis is known in the prior art. A tiltable bucket is rotated by a tilt cylinder coupled to the bucket.

In order to obtain a tilt angle, which is a rotation angle of the bucket about the center of a tilt axis, a method for using an inclination angle sensor for detecting the inclination angle of the bucket is known (see Japanese Patent Laid-open No. 2014-55407).

SUMMARY

The inclination angle sensor includes a liquid-type inclination angle sensor that detects the inclination angle on the basis of a change in the liquid level in response to movement of the bucket. It is difficult to obtain the tilt angle data, which may not be detected accurately depending on the posture of the bucket corresponding to the motions of the work implement, such as the boom or the arm, when using the liquid-type inclination angle sensor.

Accordingly, a method has been considered to detect the stroke length of a tilt cylinder and calculate the tilt angle based on the stroke length using the law of cosines. According to this method, it is possible to detect the tilt angle with greater accuracy without relying on the posture of the bucket. However, because the tilt angle calculation method differs according to whether the tilt cylinder is disposed so as to rotate the bucket in the clockwise direction due to extension or whether the tilt cylinder is disposed so as to rotate the bucket in the clockwise direction due to contraction when viewing the bucket from the vehicle body side, the method is complicated and requires the operator to previously input the disposition of the tilt cylinder.

An object of the present invention is to provide a work vehicle and a method for obtaining a tilt angle in which the tilt angle can be detected easily in consideration of the above conditions.

A work vehicle according to a first aspect is equipped with a vehicle body, a work implement, a tilt cylinder, a stroke length detecting unit, a tilt cylinder disposition data creating unit, and a bucket information computing unit. The work implement has a bucket that is configured to rotate about a tilt axis. The tilt cylinder is configured to cause the bucket to rotate about the tilt axis. The stroke length detecting unit is configured to detect a stroke length of the tilt cylinder. The tilt cylinder disposition data creating unit is configured to create tilt cylinder disposition data which indicates whether a disposition of the tilt cylinder is a first disposition or a second disposition when viewing the bucket from the vehicle body side. The bucket disposed in the first disposition is rotated in the clockwise direction due to extension.

The bucket disposed in the second disposition is rotated in the clockwise direction due to contraction. The bucket information computing unit is configured to obtain a tilt angle of the bucket based on the stroke length on the basis of the tilt cylinder disposition data.

According to the work vehicle as in the first aspect, the tilt angle can be obtained easily by using a suitable method for calculating the tilt angle according to whether the tilt cylinder is in the first disposition or the second disposition.

The work vehicle according to a second aspect is equipped with a display unit and a display controller. The display controller is configured to cause a selection screen for selecting the first disposition or the second disposition to be displayed on the display unit. The tilt cylinder disposition data creating unit creates the tilt cylinder disposition data on the basis of the selection results from the selection screen.

The work vehicle according to a third aspect is related to the second aspect, and the display controller is configured to cause a first pattern and a second pattern to be displayed on the display unit as the first disposition. When the bucket is disposed in the first pattern, a first end part of the tilt cylinder coupled to the bucket is positioned to the left of the tilt axis and a second end part provided opposite the first end part of the tilt cylinder is positioned below a coupling line that couples the tilt axis and the first end part when viewing the bucket from the vehicle body side. When the bucket is disposed in the second pattern, the first end part is positioned to the right of the tilt axis and the second end part is positioned above the coupling line when viewing the bucket from the vehicle body side. The display controller is configured to cause a third pattern and a fourth pattern to be displayed on the display unit as the second position. When the bucket is disposed in the third pattern, the first end part is positioned to the right of the tilt axis and the second end part is positioned below the coupling line when viewing the bucket from the vehicle body side. When the bucket is disposed in the fourth pattern, the first end part is positioned to the left of the tilt axis and the second end part is positioned above the coupling line when viewing the bucket from the vehicle body side.

The work vehicle according to a fourth aspect is related to any one of the first to third aspects, and the bucket information computing unit is configured to select one of a first computing equation corresponding to the first disposition and a second computing equation corresponding to the second disposition on the basis of the tilt cylinder disposition data. The bucket information computing unit is configured to use a selected computing equation to obtain the tilt angle of the bucket based on the stroke length.

The work vehicle according to a fifth aspect is related to the second or third aspect, and the display controller displays is configured to cause a bucket file which indicates the tilt cylinder disposition data to be displayed on the display unit. The tilt cylinder disposition data creating unit is configured to obtain the tilt cylinder disposition data on the basis of a selection result of the bucket file.

A method for obtaining a tilt angle according to a sixth aspect includes a step creating tilt cylinder disposition data which indicates whether a disposition of a tilt cylinder is a first disposition or a second disposition when viewing a bucket from the vehicle body side, and a step obtaining a tilt angle of the bucket based on a stroke length of the tilt cylinder on the basis of the tilt cylinder disposition data. The bucket disposed in the first disposition is rotated in the clockwise direction due to extension. The bucket disposed in the second disposition is rotated in the clockwise direction due to contraction. The bucket is disposed at the front of a vehicle body.

According to aspects of the present invention, a work vehicle and a method for obtaining a tilt angle can be provided in which the tilt angle can be detected easily.

DESCRIPTION OF EXEMPLARY EMBODIMENTS

Overall Configuration of a Hydraulic Excavator CM

A configuration of a hydraulic excavator construction machinery (CM) as an example of a work vehicle according to an exemplary embodiment shall be explained in detail with reference to the drawings. The positional relationships of the configurations will be explained hereinbelow while referring to a global coordinate system and a local coordinate system.

The global coordinate system is based on an origin Pg (see FIG. 7) positioned in a work area and fixed on the Earth. The global coordinate system is defined by a XgYgZg Cartesian coordinate system. The Xg-axis direction is one direction in a horizontal plane, the Yg-axis direction is a direction orthogonal to the Xg-axis direction in the horizontal plane, and the Zg-axis direction is a direction orthogonal to both the Xg-axis direction and the Yg-axis direction. Therefore, the Xg axis is orthogonal to the YgZg plane, the Yg axis is orthogonal to the XgZg plane, and the Zg axis is orthogonal to the XgYg plane. The XgYg plane is parallel to the horizontal plane and the Zg-axis direction is in the vertical direction. Further, the respective rotational directions around the Xg axis, the Yg axis, and the Zg axis are the θXg direction, the θYg direction, and the θZg direction.

The local coordinate system is based on an origin P0 (see FIG. 7) fixed on a vehicle body 1 of the hydraulic excavator CM. The origin P0 which is the reference position of the local coordinate system is positioned on the center of revolution AX of a revolving superstructure 3. The local coordinate system is defined by a XYZ Cartesian coordinate system. The X-axis direction is one direction in a predetermined horizontal plane, the Y-axis direction is a direction orthogonal to the X-axis direction in the predetermined horizontal plane, and the Z-axis direction is a direction orthogonal both the X-axis direction and the Y-axis direction. The X axis is orthogonal to the YZ plane, the Y axis is orthogonal to the XZ plane, and the Z axis is orthogonal to the XY plane. Further, the respective rotational directions around the X axis, the Y axis, and the Z axis are the Ox direction, the θy direction, and the θz direction.

Figure 1:
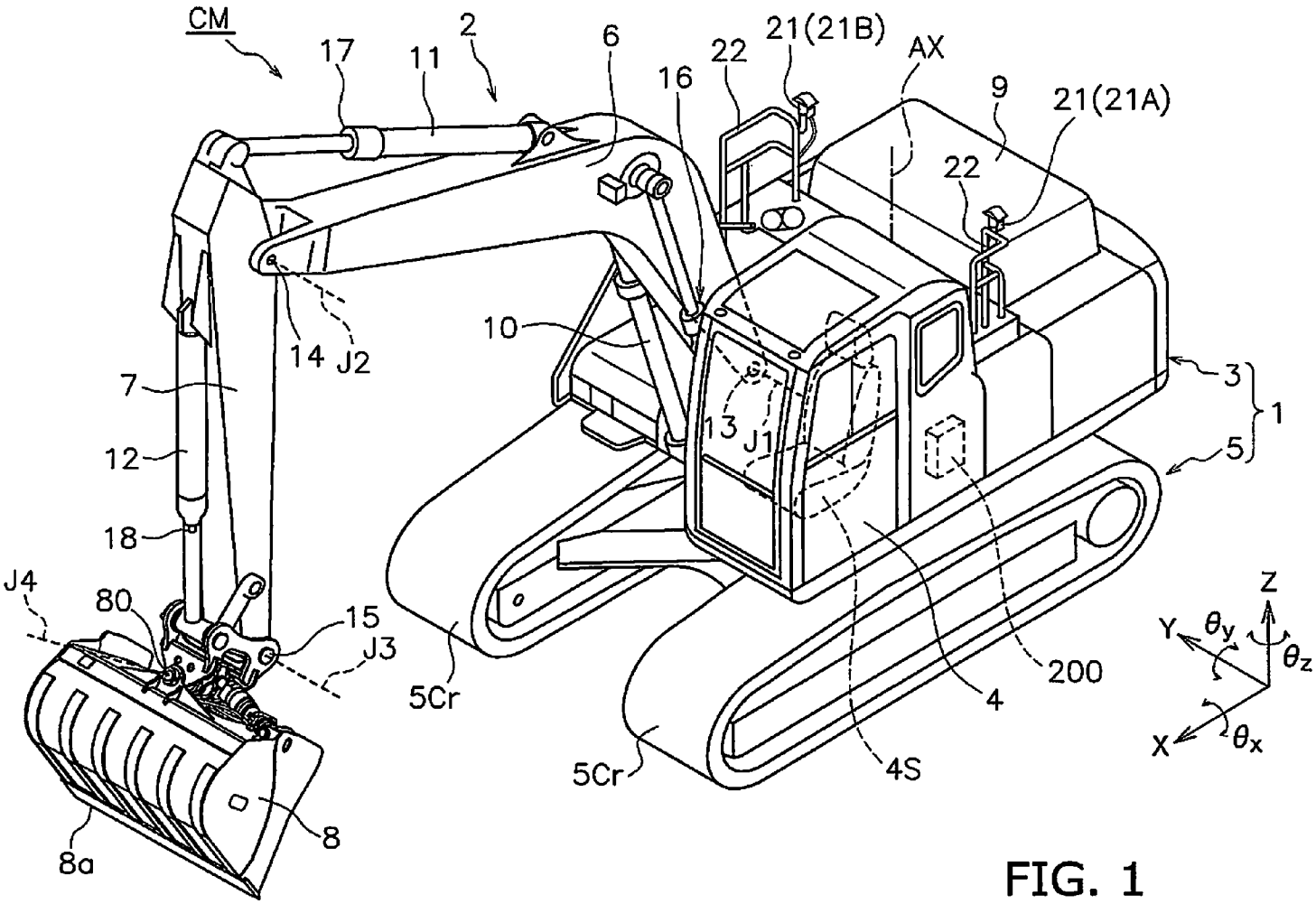
FIG. 1 is a perspective view of a hydraulic excavator.

FIG. 1 is a perspective view illustrating an overall configuration of the hydraulic excavator CM. The hydraulic excavator CM is equipped with the vehicle body 1 and working equipment 2. The hydraulic excavator CM has mounted thereon a control system 200 for executing excavation control.

In the following explanation, "front," "rear," "left" and "right" are defined by the positional relationships when the attachment position of the work implement 2 is in the forward direction as seen from the vehicle body 1. The front-back direction is the X-axis direction and the left-right direction is the Y-axis direction. The left-right direction is the same as the width direction of the vehicle (referred to below as "vehicle width direction").

The vehicle body 1 has the revolving superstructure 3, a cab 4, and a travel device 5. The revolving superstructure 3 is disposed on the travel device 5. The travel device 5 supports the revolving superstructure 3. The revolving superstructure 3 is able to rotate about the center of the axis of revolution AX. An operating seat 4S on which the operator sits is provided inside the cab 4. The operator operates the hydraulic excavator CM in the cab 4. The travel device 5 has a pair of crawler belts 5Cr. The pair of crawler belts 5Cr rotate thereby allowing the hydraulic excavator CM to travel.

The revolving superstructure 3 has an engine room 9 in which an engine and a hydraulic pump and the like are housed, and a counterweight provided in the rear part of the revolving superstructure 3. A handrail 22 is provided in front of the engine room 9 on the revolving superstructure 3.

Figure 2:
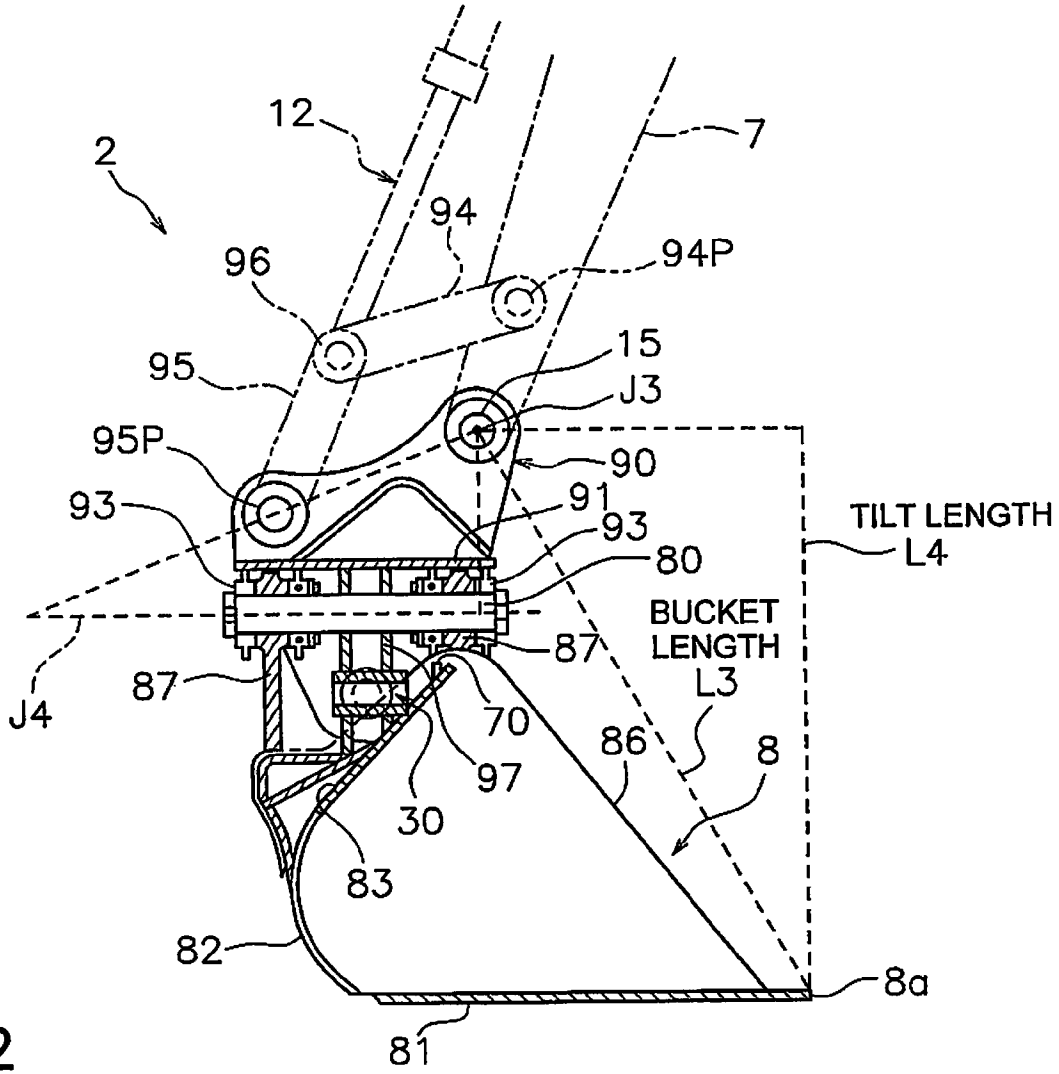
FIG. 2 is a side cross-sectional view illustrating a configuration of the vicinity of a tilt cylinder and a bucket.

The work implement 2 is connected to the revolving superstructure 3. The work implement 2 includes a boom 6, an arm 7, a bucket 8, a boom cylinder 10, an arm cylinder 11, a bucket cylinder 12, and a tilt cylinder (bucket tilt cylinder) 30 (FIGS. 2 and 3).

The boom 6 is connected to the revolving superstructure 3 via a boom pin 13. The arm 7 is connected to the boom 6 via an arm pin 14. The bucket 8 is connected to the arm 7 via a bucket pin 15 and a tilt pin 80. The boom cylinder 10 drives the boom 6. The arm cylinder 11 drives the arm 7. The bucket cylinder 12 and the tilt cylinder 30 drive the bucket 8. The proximal end of the boom 6 is connected to the revolving superstructure 3. The distal end part of the boom 6 is connected to the proximal end part of the arm 7. The distal end part of the arm 7 is connected to the proximal end part of the bucket 8. The boom cylinder 10, the arm cylinder 11, the bucket cylinder 12, and the tilt cylinder 30 are all hydraulic cylinders and are driven by hydraulic fluid.

Figure 3:
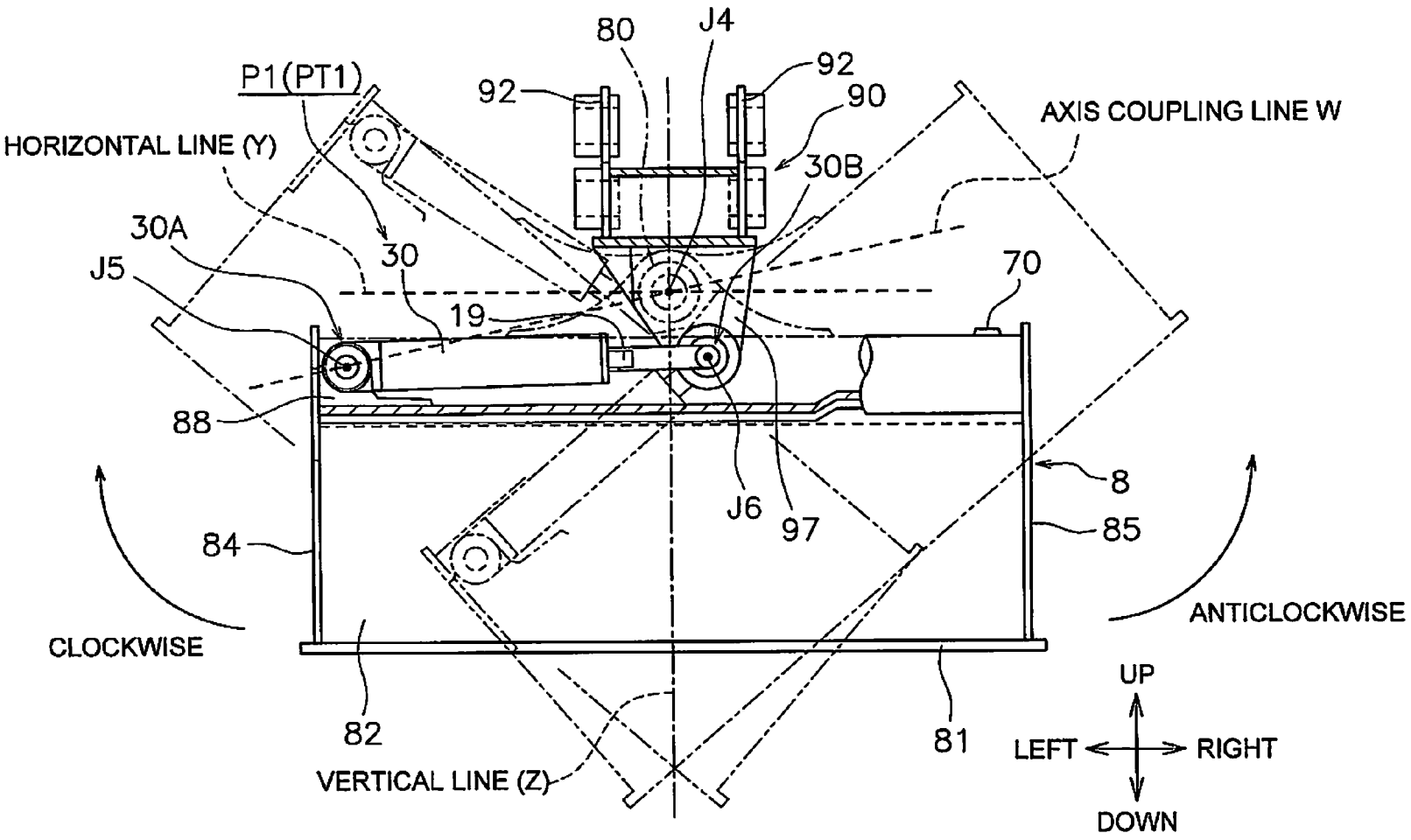
FIG. 3 is a front view illustrating a configuration of the vicinity of the tilt cylinder and the bucket as seen from the vehicle body side.

The work implement 2 has a first stroke sensor 16, a second stroke sensor 17, a third stroke sensor 18, and a fourth stroke sensor 19 (FIG. 3). The first stroke sensor 16 is disposed on the boom cylinder 10 and detects a stroke length of the boom cylinder 10 (hereinbelow referred to as "boom cylinder length"). The second stroke sensor 17 is disposed on the arm cylinder 11 and detects a stroke length of the arm cylinder 11 (hereinbelow referred to as "arm cylinder length"). The third stroke sensor 18 is disposed on the bucket cylinder 12 and detects a stroke length of the bucket cylinder 12 (hereinbelow referred to as "bucket cylinder length"). The fourth stroke sensor 19 is disposed on the tilt cylinder 30 and detects a stroke length of the tilt cylinder 30 (hereinbelow referred to as "tilt cylinder length").

The fourth stroke sensor 19 is an example of a "stroke length detecting unit" according to the present exemplary embodiment. The bucket 8, the tilt cylinder 30, and the fourth stroke sensor 19 configure the "bucket device" according to the present embodiment.

The boom 6 is capable of rotating relative to the revolving superstructure 3 about the center of a boom axis J1 which is a rotating axis. The arm 7 is capable of rotating relative to the boom 6 about the center of an arm axis J2 which is a rotating axis parallel to the boom axis J1. The bucket 8 is capable for rotating with respect to the arm 7 about the center of a bucket axis J3 which is a rotating axis parallel to the boom axis J1 and the arm axis J2. The bucket 8 is capable of rotating relative to the arm 7 about the center of a tilt axis J4 which is a rotating axis orthogonal to the bucket axis J3. The boom pin 13 has the boom axis J1. The arm pin 14 has the arm axis J2. The bucket pin 15 has the bucket axis J3. The tilt pin 80 has the tilt axis J4.

The boom axis J1, the arm axis J2, and the bucket axis J3 are all parallel to the Y axis. The tilt axis J4 is perpendicular to the Y axis. The boom 6, the arm 7, and the bucket 8 are all capable of rotating in the θy direction.

Configuration of Bucket 8

A configuration of the bucket 8 will be explained next. FIG. 2 is a side cross-sectional view illustrating a configuration of the vicinity of the tilt cylinder 30 and the bucket 8 as seen in the radial direction perpendicular to the tilt axis J4. FIG. 3 is a front view illustrating a configuration of the vicinity of the tilt cylinder 30 and the bucket 8 as seen in an axial direction parallel to the tilt axis J4.

The bucket 8 disposed at the reference position is depicted in FIG. 2. FIG. 3 illustrates the bucket 8 as seen from the vehicle body 1 side. The bucket 8 disposed in the reference position is depicted with solid lines, and the bucket 8 tilted as far as left and right tilt end positions is depicted with dashed lines in FIG. 3. The reference position of the bucket 8 refers to a position of the bucket 8 while the upper edge or the lower edge of the bucket 8 is parallel to the horizontal plane when the tilt axis J4 is assumed as being included on the horizontal plane. The tilt angle of the bucket 8 is "0 degrees" at the reference position of the bucket 8. The tilt end position signifies the position of the bucket 8 when the bucket 8 is tilted as far as the greatest tilt angle.

The bucket 8 is a tiltable bucket. The work implement 2 has the bucket 8 which is capable of rotating relative to the arm 7 about the center of the bucket axis J3 and the center of the tilt axis J4 which is orthogonal to the bucket axis J3. The bucket 8 is supported by the arm 7 in a rotatable manner about the center of the bucket axis J3 of the bucket pin 15. The bucket 8 is supported by the arm 7 in a rotatable manner about the center of the tilt axis J4 of the tilt pin 80.

The bucket 8 is connected to the distal end part of the arm 7 via a connecting member 90. The bucket pin 15 couples the arm 7 and the connecting member 90. The tilt pin 80 couples the connecting member 90 and the bucket 8. The bucket 8 is connected in a rotatable manner to the arm 7 via the connecting member 90.

The bucket 8 has a bottom plate 81, a back plate 82, an upper plate 83, a left side plate 84, and a right side plate 85. An opening section 86 of the bucket 8 is formed by the bottom plate 81, the upper plate 83, the left side plate 84, and the right side plate 85.

The bucket 8 has a bracket 87 provided on an upper part of the upper plate 83. The bracket 87 couples the connecting member 90 and the tilt pin 80.

The connecting member 90 has a plate member 91 and brackets 92 and 93. The bracket 92 is provided on the upper surface of the plate member 91. The bracket 93 is provided on the lower surface of the plate member 91. The bracket 92 couples the arm 7 and a below-mentioned second link member 95. The bracket 93 is disposed on an upper part of the bracket 87 and couples the tilt pin 80 and the bracket 87.

The bucket pin 15 couples the bracket 92 of the connecting member 90 and the distal end part of the arm 7. The tilt pin 80 couples the bracket 93 of the connecting member 90 and the bracket 87 of the bucket 8. As a result, the connecting member 90 and the bucket 8 are capable of rotating about the center of the bucket axis J3 relative to the arm 7, and the bucket 8 is capable of rotating about the center of the tilt axis J4 relative to the connecting member 90.

The work implement 2 has a first link member 94 and the second link member 95. The first link member 94 is connected to the arm 7 in a rotatable manner via a first link pin 94P. The second link member 95 is connected to the bracket 92 in a rotatable manner via a second link pin 95P.

The proximal end part of the first link member 94 is connected to the arm 7 via the first link pin 94P. The proximal end part of the second link member 95 is connected to the bracket 92 via the second link pin 95P. The distal end part of the first link member 94 and the distal end part of the second link member 95 are coupled to each other via a bucket cylinder top pin 96.

The distal end part of the bucket cylinder 12 is connected to the distal end part of the first link member 94 and the distal end part of the second link member 95 in a rotatable manner via the bucket cylinder top pin 96. The connecting member 90 rotates about the center of the bucket axis J3 with the bucket 8 due to the extension and contraction of the bucket cylinder 12. The tilt axis J4 of the tilt pin 80 rotates about the center of the bucket axis J3 with the bucket 8 due to the rotation of the bucket 8 about the center of the bucket axis J3.

The tilt cylinder 30 is coupled to the bucket 8 and the connecting member 90 as illustrated in FIG. 3. The tilt cylinder 30 causes the bucket 8 to rotate about the center of the tilt axis J4. A first end part 30A of the tilt cylinder 30 is coupled in a rotatable manner to a bracket 88 provided on the bucket 8. The first end part 30A is capable of rotating about the center of a first cylinder rotating axis J5. The first end part 30A is the distal end part of the cylinder body of the tilt cylinder 30. The bracket 88 is disposed in a position away from the tilt axis J4 in the vehicle width direction. The bracket 88 is disposed at an upper end part of the bucket 8 in the vehicle width direction. A second end part 30B of the tilt cylinder 30 is connected in a rotatable manner to a bracket 97 provided on the connecting member 90. The second end part 30B is capable of rotating about the center of a second cylinder rotating axis J6. The bracket 97 is provided on the lower surface of the plate member 91. The bracket 97 is formed in a substantially triangular shape as seen in a front view.

In the present exemplary embodiment, the first end part 30A of the tilt cylinder 30 is positioned below the tilt axis J4 when viewing the bucket 8 from the vehicle body 1 side and when the bucket 8 is disposed in the reference position. The first end part 30A is positioned between the tilt axis J4 and the bucket 8. The first end part 30A is positioned on the same side as the bucket 8 relative to the horizontal plane (XgYg plane) passing through the tilt axis J4.

The first end part 30A of the tilt cylinder 30 is positioned away from the tilt axis J4 in the vehicle width direction when viewing the bucket 8 from the side of the vehicle body 1 and when the bucket 8 is disposed in the reference position. In the present exemplary embodiment, the first end part 30A is positioned to the left of the tilt axis J4. The first end part 30A is positioned on the same side as the left side plate 84 relative to the vertical plane (Z plane) passing through the tilt axis J4. The first end part 30A is positioned between the left side plate 84 of the bucket 8 and the tilt axis J4.

Moreover, the second end part 30B of the tilt cylinder 30 is spaced away from an axis coupling line W (example of a "coupling line") that passes through the tilt axis J4 and the first cylinder rotating axis J5 when viewing the bucket 8 from the vehicle body 1 side and when the bucket 8 is disposed in the reference position. That is, the second end part 30B is not positioned on the axis coupling line W. In the present exemplary embodiment, the second end part 30B is positioned below the axis coupling line W. The second end part 30B is positioned between the axis coupling line W and the bucket 8. The second end part 30B is positioned on the same side as the bucket 8 relative to the axis coupling line W. The second end part 30B is positioned on the same side as the bucket 8 relative to a horizontal line.

In this way, the first end part 30A is positioned to the left of the tilt axis J4 and the second end part 30B is positioned below the axis coupling line W when viewing the bucket 8 from the vehicle body 1 side. As a result, the tilt cylinder 30 rotates the bucket 8 in the clockwise direction due to extension and rotates the bucket 8 in the anticlockwise direction due to contraction. In the present exemplary embodiment, the disposition of the tilt cylinder 30 such that the bucket 8 is rotated in the clockwise direction due to extension is referred to as a "first disposition P1." In the present exemplary embodiment, the pattern when the first end part 30A is positioned to the left of the tilt axis J4 and the second end part 30B is positioned below the axis coupling line W is referred to as a "first pattern PT1."

Figure 4:
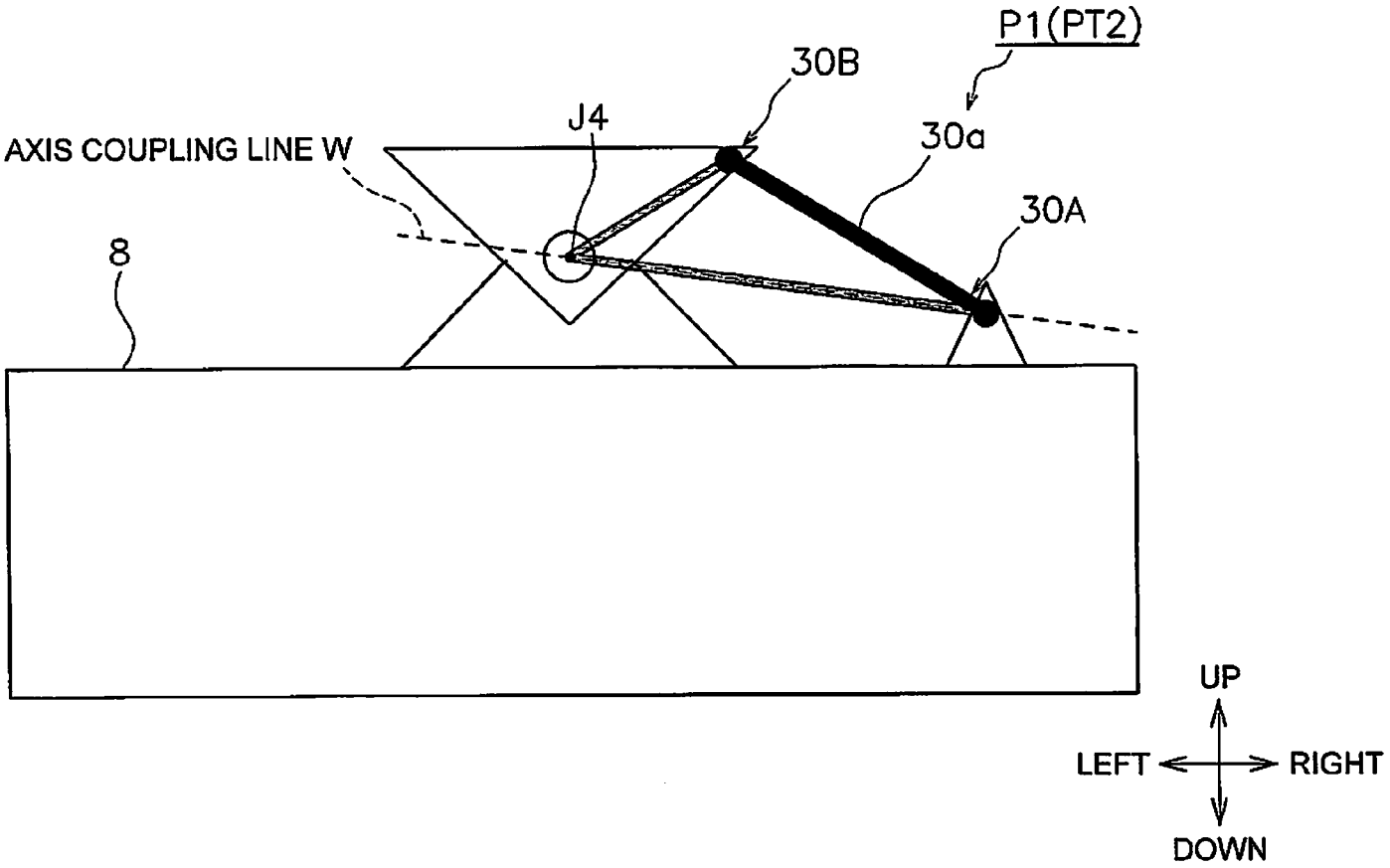
FIG. 4 is a front view illustrating a configuration of the vicinity of the tilt cylinder and the bucket as seen from the vehicle body side.

Moreover, the "first disposition P1" of the tilt cylinder 30 includes the first end part 30A being positioned to the right of the tilt axis J4 and the second end part 30B being positioned above the axis coupling line W when viewing the bucket 8 from the vehicle body 1 side as depicted by the tilt cylinder 30*a* in FIG. 4. In this case as well, the tilt cylinder 30*a* is able to rotate the bucket 8 in the clockwise direction due to extension. In the present exemplary embodiment, the pattern when the first end part 30A is positioned to the right of the tilt axis J4 and the second end part 30B is positioned above the axis coupling line W is referred to as a "second pattern PT2."

Meanwhile in the present exemplary embodiment, the disposition of the tilt cylinder 30 such that the bucket 8 is rotated in the clockwise direction due to contraction is referred to as a "second disposition P2."

Figure 5:
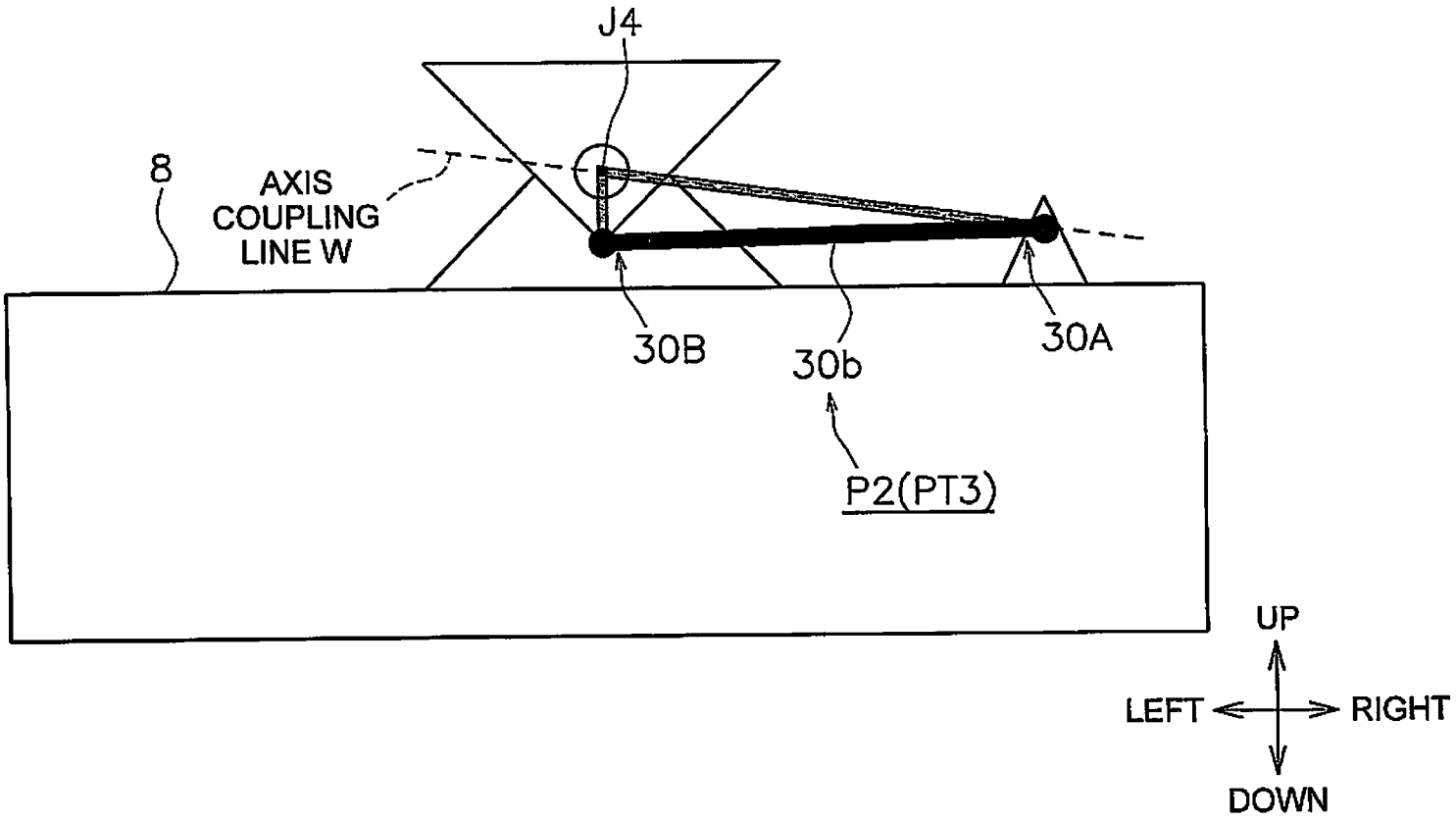
FIG. 5 is a front view illustrating a configuration of the vicinity of the tilt cylinder and the bucket as seen from the vehicle body side.

The "second disposition P2" of the tilt cylinder 30 includes the first end part 30A being positioned to the right of the tilt axis J4 and the second end part 30B being positioned below the axis coupling line W when viewing the bucket 8 from the vehicle body 1 side as depicted by the tilt cylinder 30*b* in FIG. 5. In this case as well, the tilt cylinder 30*b* is able to rotate the bucket 8 in the clockwise direction due to contraction. In the present exemplary embodiment, the pattern when the first end part 30A is positioned to the right of the tilt axis J4 and the second end part 30B is positioned below the axis coupling line W is referred to as a "third pattern PT3."

Figure 6:
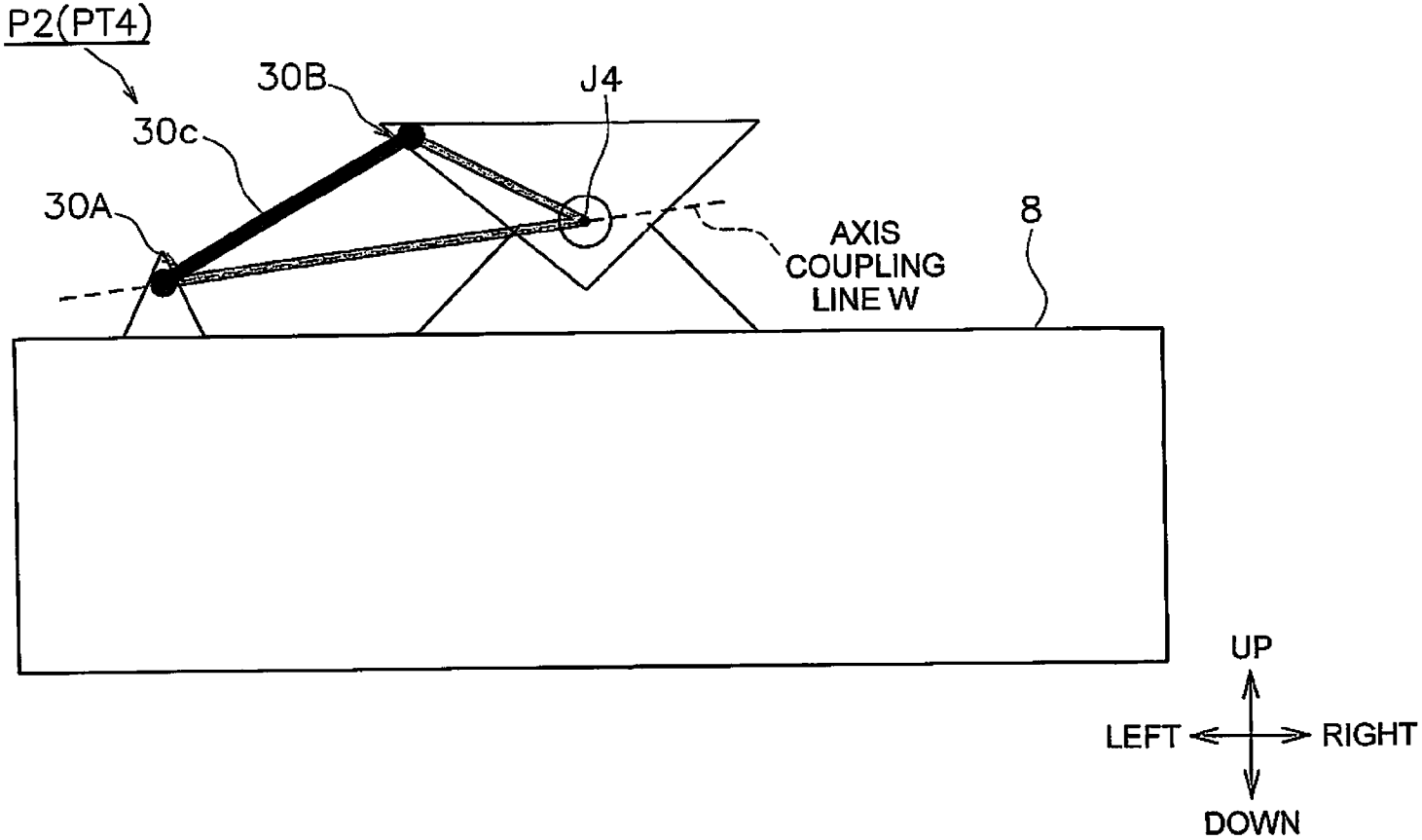
FIG. 6 is a front view illustrating a configuration of the vicinity of the tilt cylinder and the bucket as seen from the vehicle body side.

The "second disposition P2" of the tilt cylinder 30 includes the first end part 30A being positioned to the left of the tilt axis J4 and the second end part 30B being positioned above the axis coupling line W when viewing the bucket 8 from the vehicle body 1 side as depicted by the tilt cylinder 30*c* in FIG. 6. In this case, the tilt cylinder 30*c* is able to rotate the bucket 8 in the clockwise direction due to contraction. In the present exemplary embodiment, the pattern when the first end part 30A is positioned to the left of the tilt axis J4 and the second end part 30B is positioned above the axis coupling line W is referred to as a "fourth pattern PT4."

Posture of the Hydraulic Excavator CM

Figure 7:
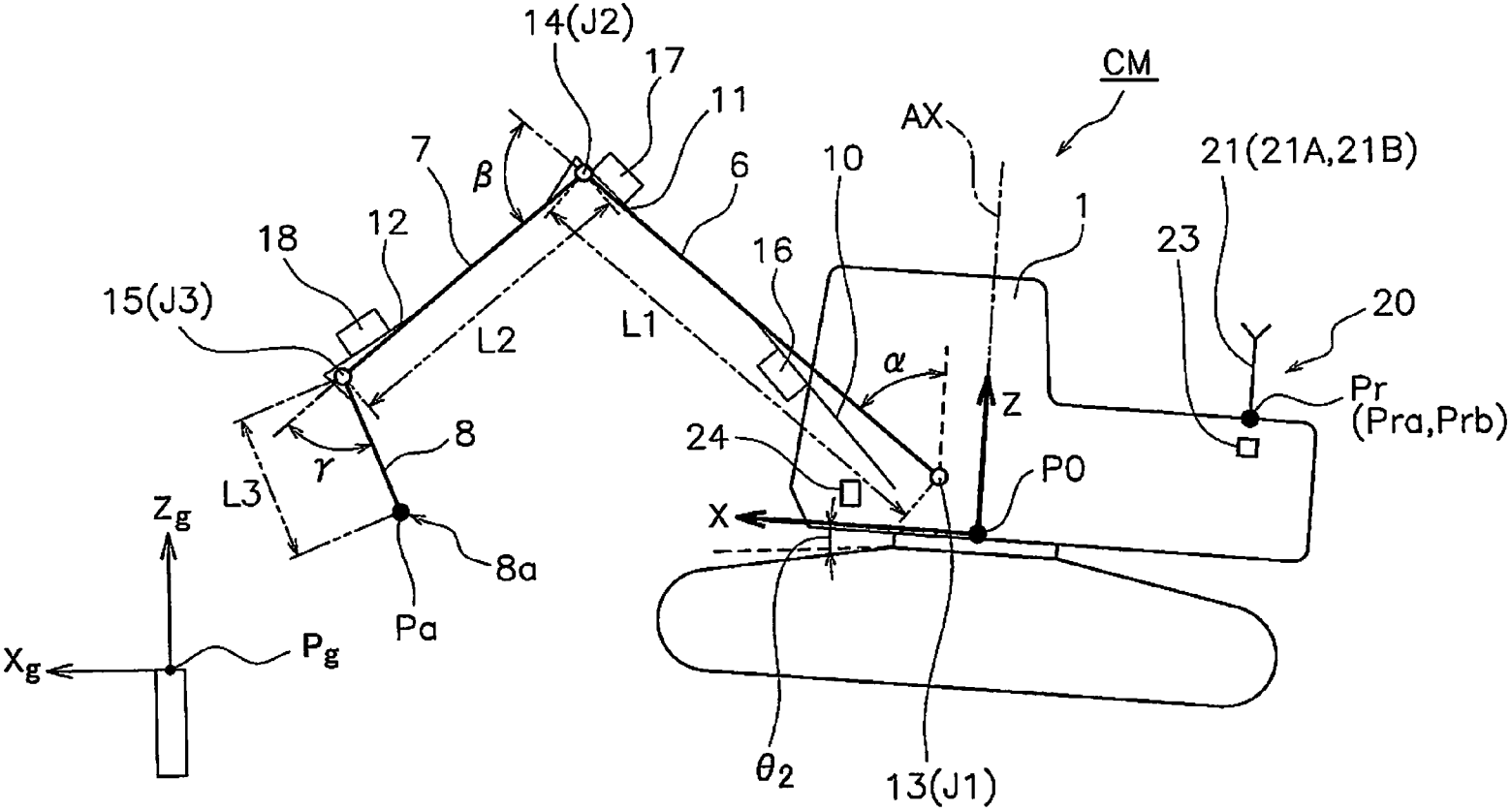
FIG. 7 is a side view schematically illustrating the hydraulic excavator.
Figure 8:
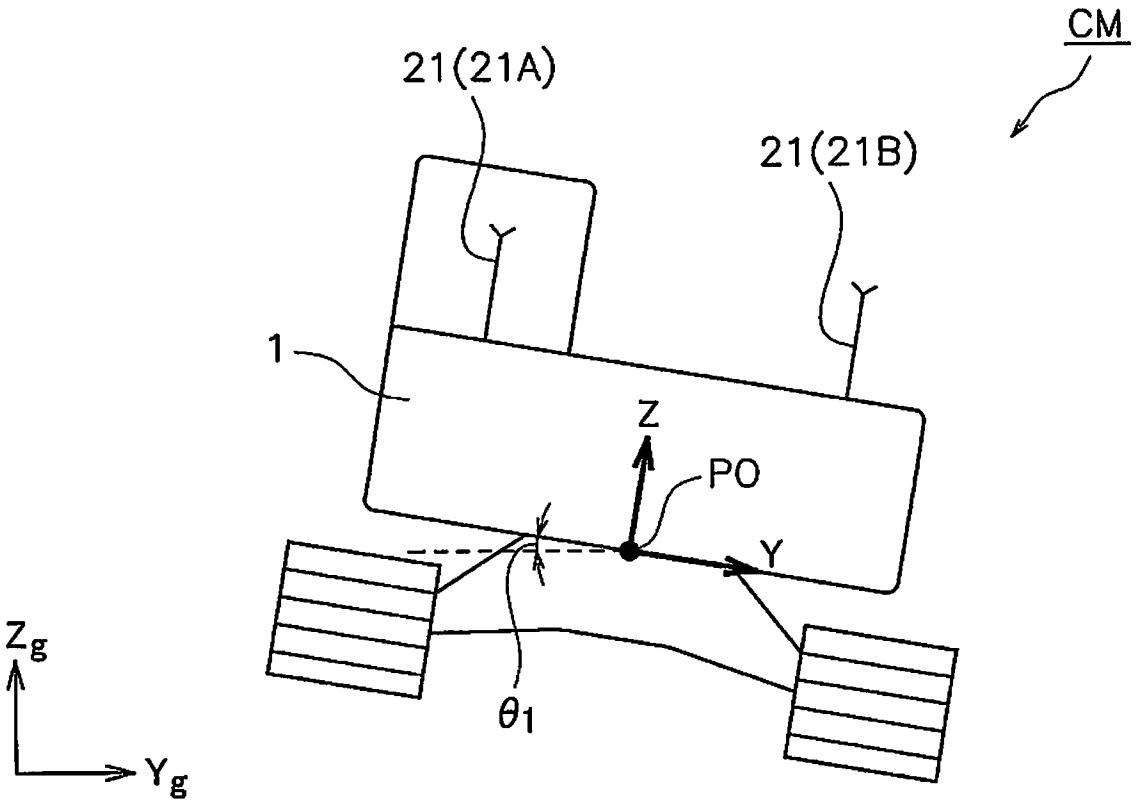
FIG. 8 is a rear view schematically illustrating the hydraulic excavator.
Figure 9:
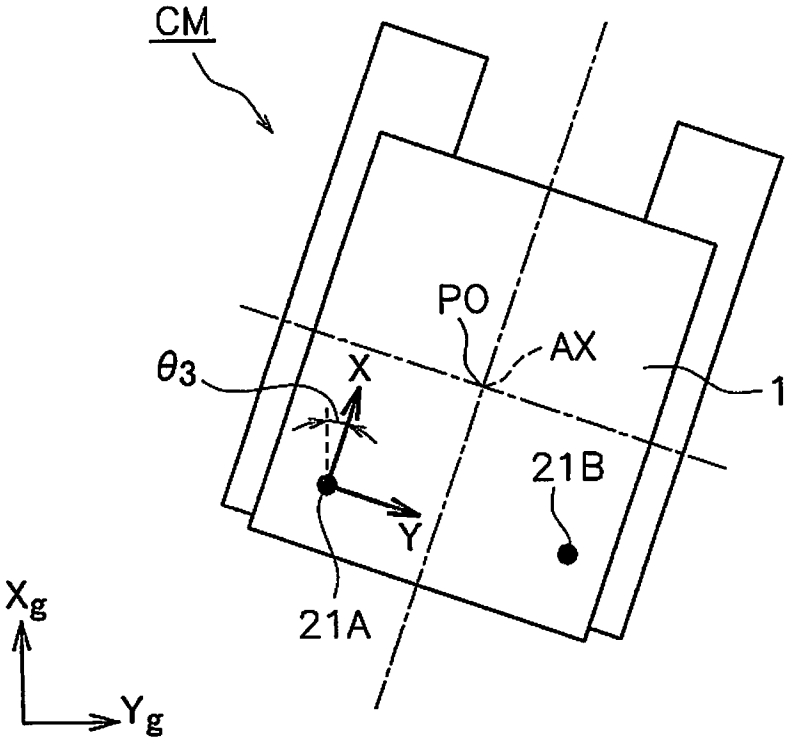
FIG. 9 is a plan view schematically illustrating the hydraulic excavator.

FIG. 7 is a side view schematically illustrating the hydraulic excavator. FIG. 8 is a rear view schematically illustrating the hydraulic excavator. FIG. 9 is a plan view schematically illustrating the hydraulic excavator.

In the following explanation, a boom length L1 is the distance between the boom axis J1 and the arm axis J2, an arm length L2 is the distance between the arm axis J2 and the bucket axis J3, and a bucket length L3 is the distance between the bucket axis J3 and a distal end part 8*a* of the bucket 8. The distal end part 8*a* of the bucket 8 is the blade tip of the bucket 8.

The hydraulic excavator CM is provided with a position detection device 20. The position detection device 20 detects vehicle body position data P which indicates the current position of the vehicle body 1, and vehicle body posture data Q which indicates the posture of the vehicle body 1. The vehicle body position data P includes information that indicates the current position (Xg position, Yg position, and Zg position) of the vehicle body 1 in the global coordinate system. The vehicle body posture data Q includes position information of the revolving superstructure 3 pertaining to the θXg direction, the θYg direction, and the θZg direction.

The vehicle body posture data Q includes an inclination angle (roll angle) θ1 (FIG. 8) in the left-right direction of the revolving superstructure 3 relative to the horizontal plane (XgXy plane), an inclination angle (pitch angle) θ2 (FIG. 7) in the front-back direction of the revolving superstructure 3 relative to the horizontal plane, and an inclination angle (yaw angle) θ3 (FIG. 9) formed by a reference azimuth (e.g., north) in the global coordinates and the azimuth in which the revolving superstructure 3 (work implement 2) is facing.

The position detection device 20 has an antenna 21, a position sensor 23, and an inclination sensor 24. The antenna 21 is an antenna for detecting the current position of the vehicle body 1. The antenna 21 is an antenna for a global navigation satellite system (GNSS). The antenna 21 outputs a signal corresponding to a received radio wave (GNSS radio wave) to the position sensor 23.

The position sensor 23 includes a three-dimensional position sensor and a global coordinate computing unit. The position sensor 23 detects an installation position Pr of the antenna 21 in the global coordinate system. The global coordinate computing unit calculates the vehicle body position data P indicating the current position of the vehicle body 1, on the basis of the installation position Pr of the antenna in the global coordinate system. The global coordinate system is a three-dimensional coordinate system based on a reference position Pg installed in the work area. As illustrated in FIG. 7, the reference position Pg is a position at the distal end of a reference marker set in the work area.

The inclination sensor 24 is provided on the revolving superstructure 3. The inclination sensor 24 has an inertial measurement unit (IMU). The position detection device 20 uses the inclination sensor 24 to obtain the vehicle body posture data Q which includes the roll angle θ1 and the pitch angle θ2.

Figure 10:
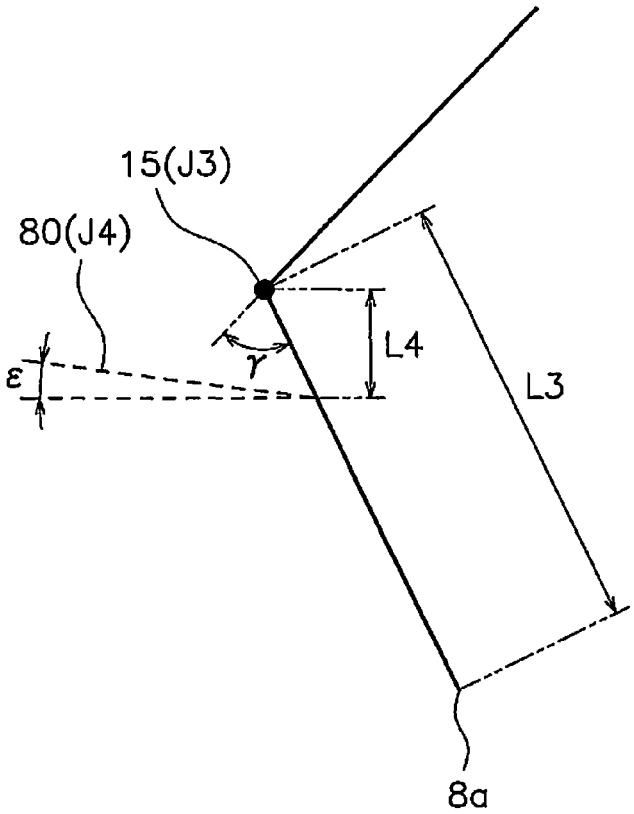
FIG. 10 is a side view schematically illustrating the bucket.
Figure 11:
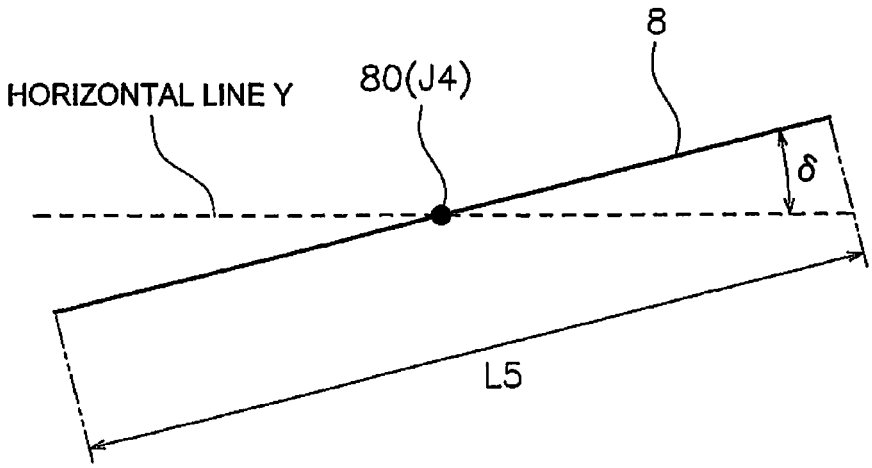
FIG. 11 is a front view schematically illustrating the bucket.

FIG. 10 is a side view schematically illustrating the bucket 8. FIG. 11 is a front view schematically illustrating the bucket 8.

In the following explanation, a tilt length L4 is the distance between the bucket axis J3 and the tilt axis J4, and a width L5 of the bucket 8 is the distance between the left side plate 84 and the right side plate 85.

A tilt angle S is a rotation angle of the bucket 8 about the center of the tilt axis and is a rotation angle of the bucket 8 relative to the XY plane in the local coordinate system. A method for obtaining the tilt angle S is described below. A tilt axis angle ϵ is an inclination angle of the tilt axis J4 relative to the XY plane in the local coordinate system. The inclination angle (tilt axis absolute angle) of the tilt axis J4 relative to the horizontal plane in the global coordinate system is calculated by a belowmentioned sensor controller 32.

Configuration of Control System 200

Figure 12:
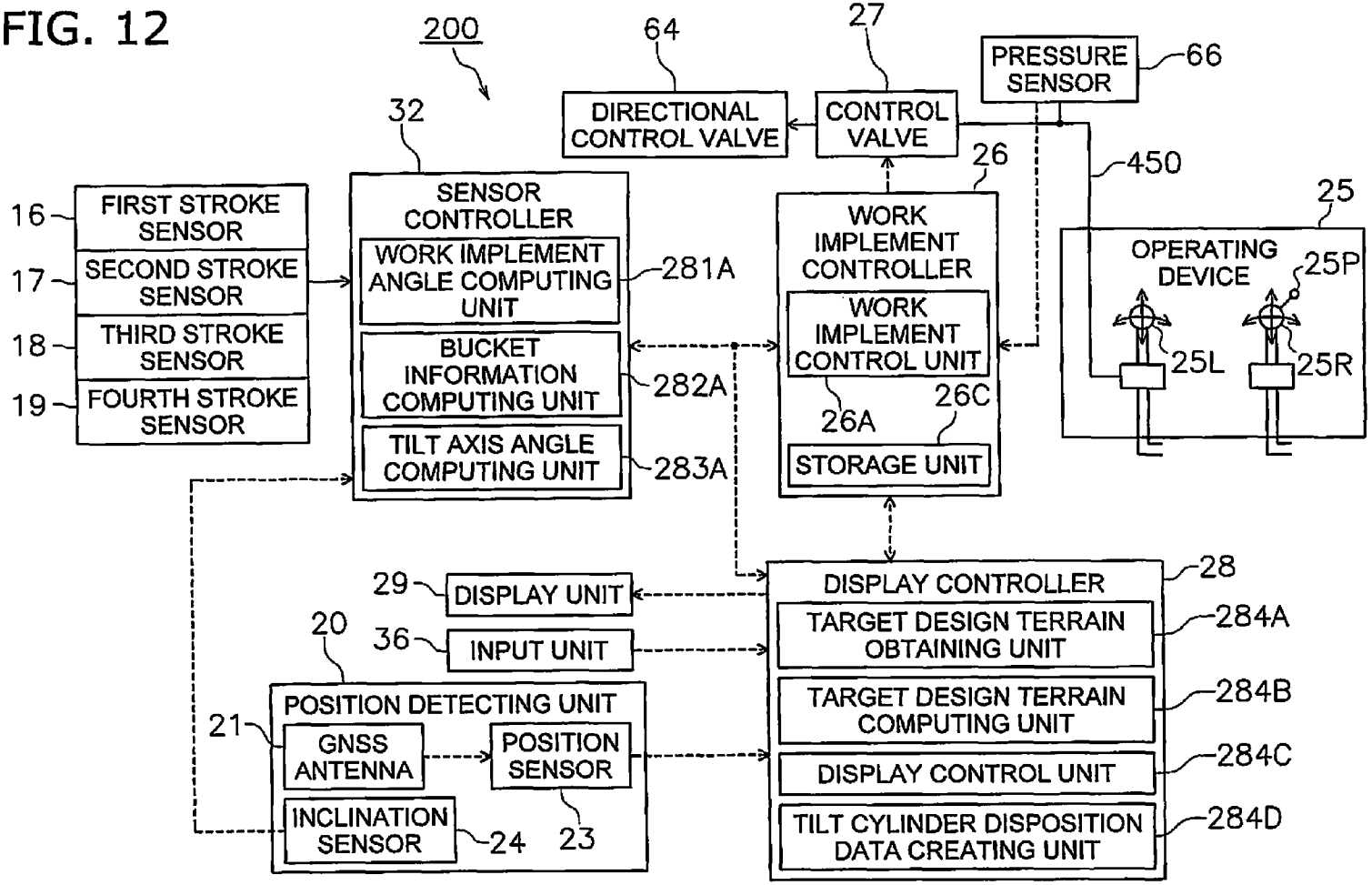
FIG. 12 is a block diagram illustrating a functional configuration of a control system.

FIG. 12 is a block diagram illustrating the functional configuration of the control system 200 mounted on the hydraulic excavator CM.

The control system 200 is provided with the position detection device 20, an operating device 25, a work implement controller 26, a pressure sensor 66, a control valve 27, a directional control valve 64, a display controller 28, a display unit 29, an input unit 36, and the sensor controller 32.

The display unit 29 is a monitor for example. A setting screen of the bucket 8 and a below-mentioned target design terrain and the like are displayed on the display unit 29. The display unit 29 includes a human machine interface (HMI) monitor as a guidance monitor for computer-aided construction.

The input unit 36 receives an input operation from the operator. A touch panel on the display unit 29 and the like may be used as the input unit 36. The input unit 36 reports the contents of the input operation by the operator to the display controller 28.

The operating device 25 is disposed in the cab 4. The operating device 25 is operated by the operator. The operating device 25 receives operations by the operator for driving the work implement 2. The operating device 25 is a pilot hydraulic pressure type of operating device. The operating device 25 has a first operating lever 25R, a second operating lever 25L, and a third operating lever 25P.

The first operating lever 25R is disposed on the right side of the operator's seat 4S for example. The second operating lever 25L is disposed on the left side of the operator's seat 4S for example. The third operating lever 25P is disposed on the first operating lever 25R for example. The third operating lever 25P may be disposed on the second operating lever 25L. The back and forth, left and right motions of the first operating lever 25R and the second operating lever 25L correspond to motions in two axes.

The boom 6 and the bucket 8 are operated by the first operating lever 25R. A front-back direction operation of the first operating lever 25R corresponds to an operation of the boom 6, and up and down motions of the boom 6 are executed in response to the front-back direction operations. The left-right direction operation of the first operating lever 25R corresponds to an operation of the bucket 8, and excavating and releasing motions of the bucket 8 are executed in response to the left-right direction operations. Rotation of the bucket 8 about the center of the bucket axis J3 is operated by left-right direction operations of the first operating lever 25R.

The arm 7 and the revolving superstructure 3 are operated by the second operating lever 25L. An operation of the second operating lever 25L in the front-back direction corresponds to an operation of the arm 7, and releasing and excavating motions of the arm 7 are executed in response to the front-back direction operations. An operation of the second operating lever 25L in the left-right direction corresponds to the turning of the revolving superstructure 3 and left and right turning motions of the revolving superstructure 3 are executed in response to the left-right direction operations.

The tilt motion of the bucket 8 about the center of the tilt axis J4 is operated with the third operating lever 25P.

Pilot hydraulic pressure of a pilot hydraulic pressure line 450 is adjusted in response to the operation amount of the operating device 25 and as a result the directional control valve 64 is driven. The directional control valve 64 adjusts the amount of hydraulic fluid supplied to the hydraulic cylinders (the boom cylinder 10, the arm cylinder 11, the bucket cylinder 12, and the tilt cylinder 30). A pressure sensor 66 for detecting the pilot hydraulic pressure is disposed on the pilot hydraulic pressure line 450. The detection result of the pressure sensor 66 is outputted to the work implement controller 26. The control valve 27 is an electromagnetic proportional control valve. The control valve 27 adjusts the pilot hydraulic pressure on the basis of a control signal from the work implement controller 26.

The sensor controller 32 has a work implement angle computing unit 281A, a bucket information computing unit 282A, and a tilt axis angle computing unit 283A.

The work implement angle computing unit 281A calculates a rotation angle α of the boom 6 relative to the vertical direction of the vehicle body 1 based on the boom cylinder length obtained on the basis of the detection results from the first stroke sensor 16. The work implement angle computing unit 281A calculates a rotation angle β of the arm 7 relative to the boom 6 based on the arm cylinder length obtained on the basis of the detection results from the second stroke sensor 17. The work implement angle computing unit 281A calculates a rotation angle γ of the bucket 8 relative to the arm 7 based on the bucket cylinder length obtained on the basis of the detection results from the third stroke sensor 18.

The bucket information computing unit 282A calculates the tilt angle δ of the bucket 8 relative to the XY plane in the local coordinate system based on the tilt cylinder length obtained on the basis of the detection results from the fourth stroke sensor 19.

Figure 13:
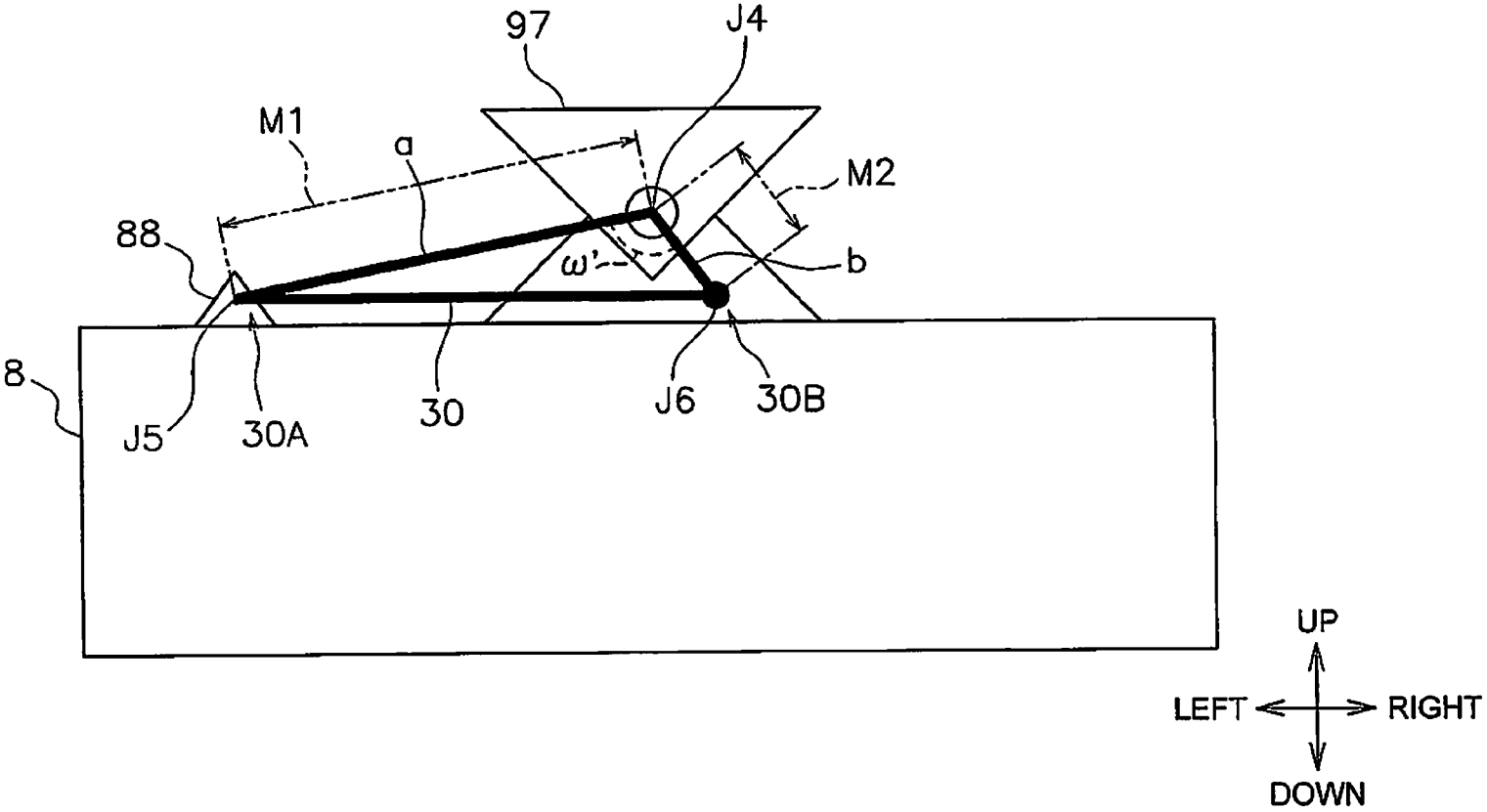
FIG. 13 is a schematic view for explaining a method for obtaining the tilt angle in which a bucket is in a reference position.
Figure 14:
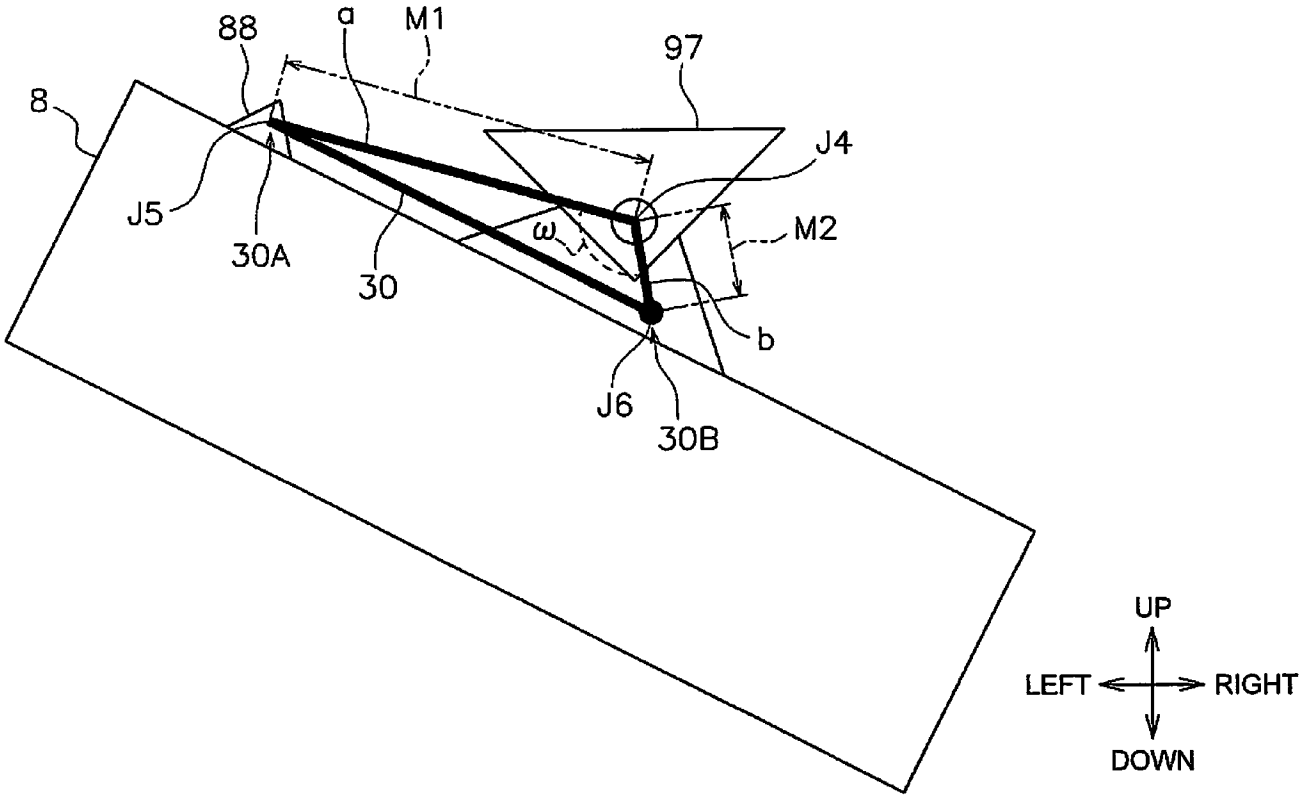
FIG. 14 is a schematic view for explaining a method for obtaining the tilt angle in which a bucket is in a tilted position.

FIGS. 13 and 14 are schematic views for explaining a method for calculating the tilt angle δ carried out by the bucket information computing unit 282A. The bucket 8 in the reference position is depicted in FIG. 13 and a tilted bucket 8 is depicted in FIG. 14.

The bucket information computing unit 282A obtains a length M1 of a first line segment "a" linking the first end part 30A of the tilt cylinder 30 and the tilt axis J4 from the display controller 28. The length M1 of the first line segment "a" is the straight line distance between the first cylinder rotating axis J5 and the tilt axis J4.

The bucket information computing unit 282A obtains a length M2 of a second line segment "b" linking the second end part 30B of the tilt cylinder 30 and the tilt axis J4 from the display controller 28. The length M2 of the second line segment "b" is the straight line distance between the second cylinder rotating axis J6 and the tilt axis J4.

The bucket information computing unit 282A obtains a reference angle ω' (see FIG. 13) formed by the first line segment "a" and the second line segment "b" when the bucket 8 is disposed at the reference position from the display controller 28.

The bucket information computing unit 282A stores the length M1 of the first line segment "a", the length M2 of the second line segment "b", and the reference angle ω'.

The bucket information computing unit 282A calculates the tilt cylinder length on the basis of the detection results from the fourth stroke sensor 19. The bucket information computing unit 282A uses the law of cosines to calculate a current inclination angle ω (see FIG. 14) in a state of being tilted based on the length M1 of the first line segment "a", the length M2 of the second line segment "b", and the tilt cylinder length.

The bucket information computing unit 282A obtains "tilt cylinder disposition data" which indicates whether the tilt cylinder 30 is disposed in the first disposition P1 or the second disposition P2, from the display controller 28. The first disposition P1 signifies the dispositions of the tilt cylinder 30 and the tilt cylinder 30*a* that rotate the bucket 8 in the clockwise direction due to extension as depicted in FIGS. 3 and 4. The second disposition P2 signifies the dispositions of the tilt cylinder 30*c* and the tilt cylinder 30*c* that rotate the bucket 8 in the clockwise direction due to contraction as depicted in FIGS. 5 and 6.

The bucket information computing unit 282A selects one of a following first computing equation Eq1 and a second computing equation Eq2 on the basis of the tilt cylinder disposition data.

First computing equation Eq1: $\omega-\omega'=\text{clockwise tilt angle } \delta$ Second computing equation Eq2: $\omega-\omega'=\text{anticlockwise tilt angle } \delta$ The first computing equation Eq1 is a computing equation corresponding to the first disposition P1. The value derived by subtracting the reference angle ω' from the inclination angle ω in the first computing equation Eq1 is calculated as the clockwise tilt angle. This is because the bucket 8 is rotated in the clockwise direction due to the extension of the tilt cylinder 30 disposed in the first disposition P1.

The second computing equation Eq2 is a computing equation corresponding to the second disposition P2. The value derived by subtracting the reference angle ω' from the inclination angle ω in the second computing equation Eq2 is calculated as the anticlockwise tilt angle. This is because the bucket 8 is rotated in the anticlockwise direction due to the extension of the tilt cylinder 30 disposed in the second disposition P2.

The bucket information computing unit 282A refers to the tilt cylinder disposition data and selects the first computing equation Eq1 when it is detected that the tilt cylinder 30 is disposed in the first disposition P1. The bucket information computing unit 282A refers to the tilt cylinder disposition data and selects the second computing equation Eq2 when it is detected that the tilt cylinder 30 is disposed in the second disposition P2. The bucket information computing unit 282A obtains the clockwise or the anticlockwise tilt angle δ on the basis of the inclination angle ω and the reference angle ω'. When the bucket 8 is disposed in the reference position as illustrated in FIG. 13, the tilt angle is "0 degrees" because the inclination angle ω and the reference angle ω' match.

The bucket information computing unit 282A creates bucket data R which indicates the shape and position of the bucket 8 in the plane of motion of the work implement 2 on the basis of the rotation angles α to γ calculated by the work implement angle computing unit 281A, the vehicle body posture data Q obtained by the inclination sensor 24, and the tilt angle δ.

The tilt axis angle computing unit 283A calculates the angle (tilt axis absolute angle) of the tilt axis J4 relative to the horizontal plane on the basis of the rotation angles α to γ and the vehicle body posture data Q. Specifically, the tilt axis angle computing unit 283A calculates the angle (tilt axis angle ϵ) of the tilt axis J4 in the local coordinate system on the basis of the rotation angles α to γ and calculates the tilt axis absolute angle in the global coordinate system on the basis of the tilt axis angle ϵ and the vehicle body posture data Q.

The sensor controller 32 outputs the rotation angles α to γ, the tilt axis angle ϵ, the tilt axis absolute angle, and the bucket data R to the display controller 28 and the work implement controller 26.

The display controller 28 obtains the vehicle body position data P and the vehicle body posture data Q from the position detection device 20. The display controller 28 obtains the bucket data R from the sensor controller 32. The display controller 28 has a target design terrain obtaining unit 284A, a target design terrain computing unit 284B, a display controller 284C, and a tilt cylinder disposition data creating unit 284D.

The target design terrain obtaining unit 284A stores target construction information (three-dimensional target design terrain data S) which indicates a stereoscopic design terrain that is a three-dimensional target design terrain of the excavation object. The three-dimensional target design terrain data S includes coordinate data and angle data of the target design terrain required for creating target design terrain data T. However, the three-dimensional target design terrain data S may be inputted to the display controller 28 via a wireless communication device for example, or may be inputted to the display controller 28 from an external memory and the like.

The target design terrain computing unit 284B creates the target design terrain data T which indicates the target design terrain that is a two-dimensional target shape of an excavation object in the plane of motion of the work implement 2, on the basis of the vehicle body position data P, the vehicle body posture data Q, the bucket data R, and the three-dimensional target design terrain data S. The target design terrain computing unit 284B outputs the target design terrain data T to the work implement controller 26.

The target design terrain computing unit 284B is able to calculate the position in the local coordinate when seen in the global coordinate system on the basis of the vehicle body position data P, the vehicle body posture data Q, and the bucket data R. The target design terrain computing unit 284B converts the target design terrain data T outputted to the work implement controller 26 to local coordinates but other computations are carried out in the global coordinate system.

The display controller 284C causes the target design terrain to be displayed on the display unit 29 on the basis of the target design terrain data T created by the target design terrain computing unit 284B. Moreover, the display controller 284C causes the posture of the hydraulic excavator CM relative to the target design terrain to be displayed on the display unit 29 on the basis of the bucket data R.

Figure 15:
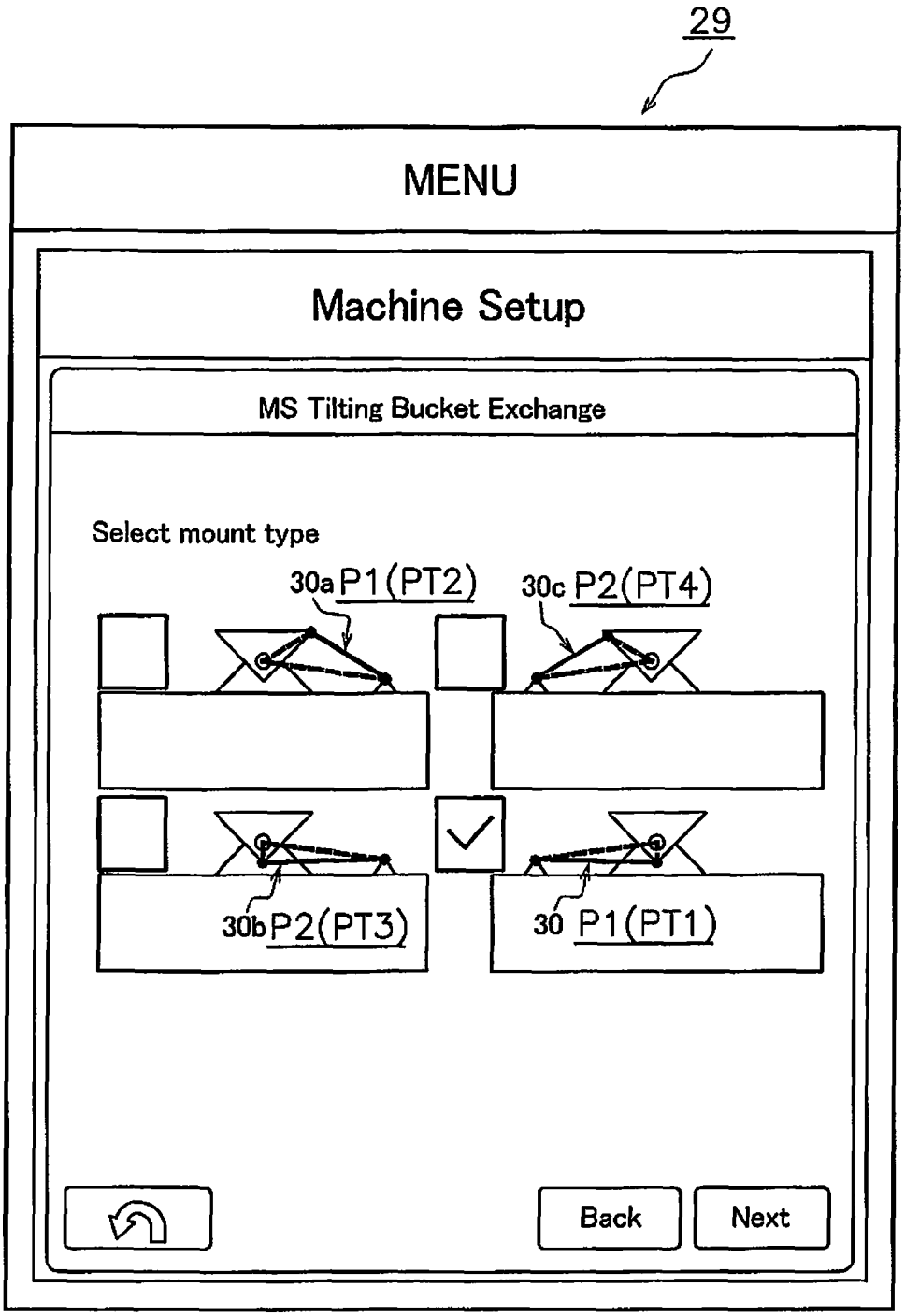
FIG. 15 illustrates selection screens of a first disposition and a second disposition of the tilt cylinder as seen from the vehicle body side.

The display controller 284C causes a selection screen for selecting whether the tilt cylinder 30 is in the first disposition P1 or the second disposition P2, on the display unit 29. FIG. 15 is an example of the selection screen. FIG. 15 illustrates four forms representing the tilt cylinder 30 (bottom right), a tilt cylinder 30*a* (upper left), a tilt cylinder 30*b* (lower left), and a tilt cylinder 30*c* (upper right) depicted respectively in FIGS. 3 to 6. The selection screen in FIG. 15 displays the tilt cylinder 30, the tilt cylinder 30*a*, the tilt cylinder 30*b*, and the tilt cylinder 30*c* as seen from the vehicle body 1 side in the same way as in FIGS. 3 to 6. The tilt cylinder 30 and the tilt cylinder 30*a* are examples of the tilt cylinder in the first disposition P1, and the tilt cylinder 30*b* and the tilt cylinder 30*c* are examples of the tilt cylinder in the second disposition P2. The tilt cylinder 30 is an example of the first pattern PT1, the tilt cylinder 30*a* is an example of the second pattern PT2, the tilt cylinder 30*b* is an example of the third pattern PT3, and the tilt cylinder 30*c* is an example of the fourth pattern PT4.

As described above, while the computation of the tilt angle by the bucket information computing unit 282A needs only information about the tilt cylinder being disposed in the first disposition P1 or the second disposition P2, due to the four patterns PT1 to PT4 being displayed on the selection screen as depicted in FIG. 15, the operator is able to easily select the disposition that conforms to the actual shape of the tilt cylinder.

The display controller 284C inserts a check mark in the selected tilt cylinder when the input unit 36 receives a selection operation by the operator. In the present exemplary embodiment, it is assumed that the tilt cylinder 30 in the first pattern PT1 is selected and thus the check mark is inserted into the tilt cylinder 30 as depicted in FIG. 15.

Figure 16:
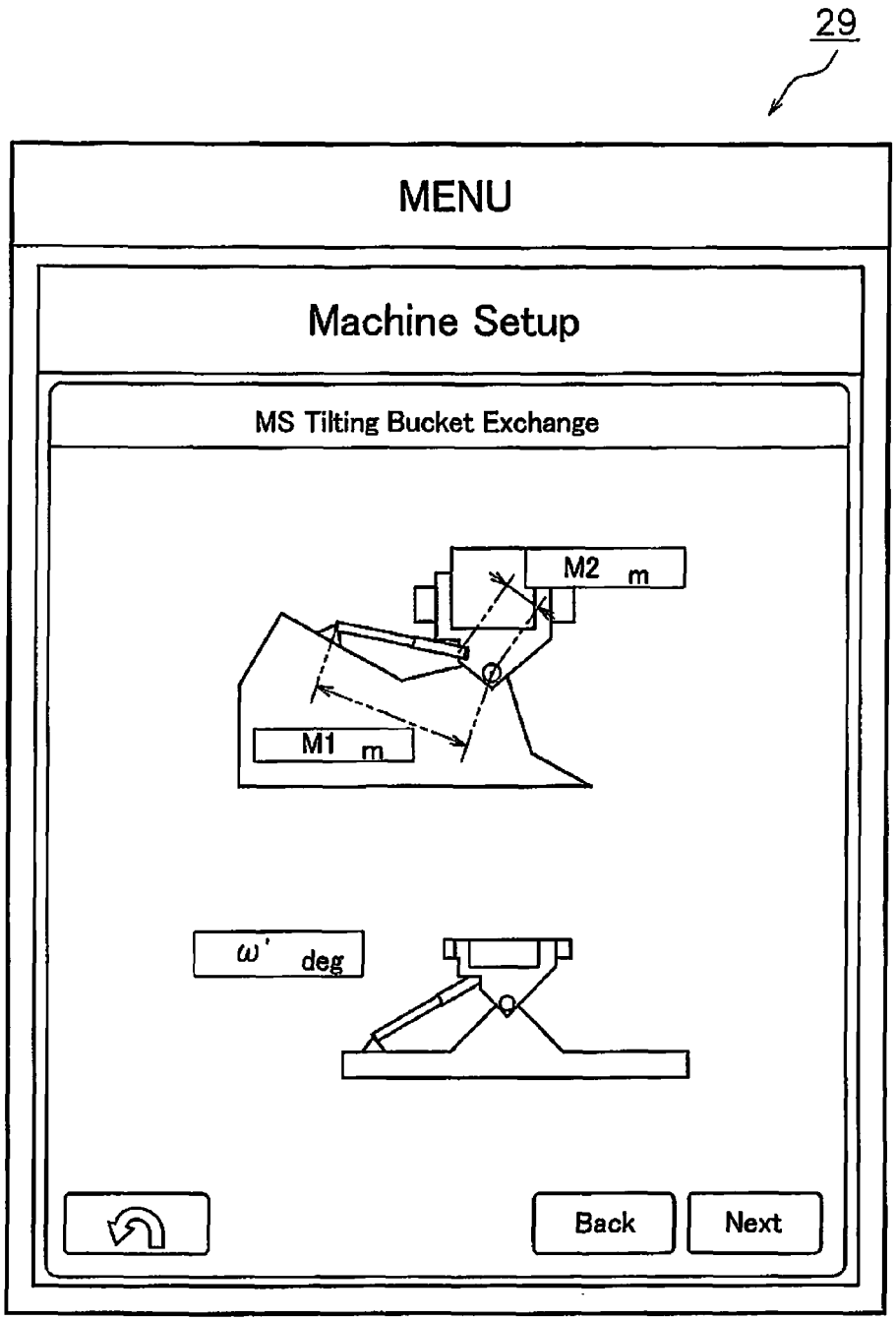
FIG. 16 is a view illustrating a dimension input screen of a display unit.

Further, the display controller 284C causes the display unit 29 to display a dimension input screen for the tilt cylinder 30 selected by the operator. FIG. 16 is an example of the dimension input screen. FIG. 16 illustrates input fields for the length M1 of the first line segment "a", the length M2 of the second line segment "b", and the reference angle ω'. The display controller 284C displays the values inputted by the operator in the input fields.

The tilt cylinder disposition data creating unit 284D creates tilt cylinder disposition data which indicates that the disposition is the first disposition P1 when the selection of the tilt cylinder of the first disposition P1 by the operator is reported by the input unit 36.

The tilt cylinder disposition data creating unit 284D creates tilt cylinder disposition data which indicates that the disposition is the second disposition P2 when the selection of the tilt cylinder of the second disposition P2 by the operator is reported by the input unit 36.

In the present exemplary embodiment, the tilt cylinder disposition data creating unit 284D creates the tilt cylinder disposition data indicating that the disposition is the first disposition P1 because it is assumed that the tilt cylinder 30 is selected. The tilt cylinder disposition data creating unit 284D transmits the created tilt cylinder disposition data to the bucket information computing unit 282A of the sensor controller 32.

Further, the tilt cylinder disposition data creating unit 284D transmits, to the bucket information computing unit 282A, the length M1 of the first line segment "a", the length M2 of the second line segment "b", and the reference angle ω' inputted with the input unit 36.

The work implement controller 26 has a work implement control unit 26A and a storage unit 26C. The work implement control unit 26A controls the motions of the work implement 2 by creating control commands to the control valve 27 on the basis of the target design terrain data T and the bucket data R obtained from the display controller 28. The work implement control unit 26A executes, for example, a limited excavation control for automatically controlling at least a portion of the motions of the work implement 2. Specifically, the work implement control unit 26A determines a limit velocity in response to the distance of the bucket 8 from the target design terrain, and controls the work implement 2 so that the velocity in the direction of the work implement 2 approaching the target design terrain is equal to or less than the limit velocity. Consequently, the position of the bucket 8 relative to the target design terrain is controlled and the bucket 8 is suppressed from intruding into the target design terrain. The work implement control unit 26A may automatically control a portion of grading work for moving the bucket 8 along the target design terrain.

Various types of programs and data required for the work implement control unit 26A to control the motions of the work implement are stored in the storage unit 26C.

Method for Obtaining Tilt Angle δ

Figure 17:
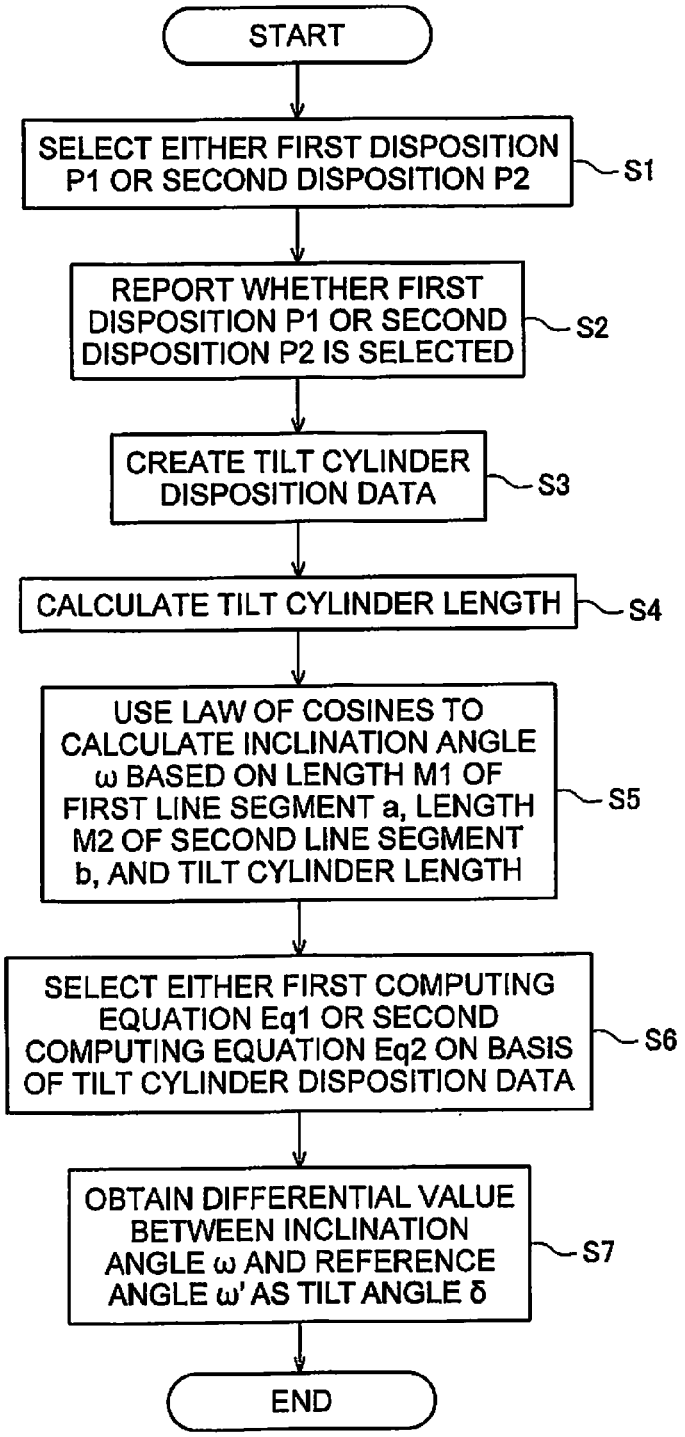
FIG. 17 is a flow diagram for explaining a method for obtaining the tilt angle.

A method for obtaining the tilt angle δ by the control system 200 will be explained with reference to the drawings. FIG. 17 is a flow diagram for explaining a method for obtaining the tilt angle δ.

In step S1, the input unit 36 receives an operator operation for selecting either the tilt cylinder of the first disposition P1 or the tilt cylinder of the second disposition P2.

In step S2, the input unit 36 reports whether the first disposition P1 or the second disposition P2 is selected to the tilt cylinder disposition data creating unit 284D.

In step S3, the tilt cylinder disposition data creating unit 284D creates the tilt cylinder disposition data indicating that the disposition of the tilt cylinder 30 is the first disposition P1 or the second disposition P2, and transmits the tilt cylinder disposition data to the bucket information computing unit 282A.

In step S4, the bucket information computing unit 282A calculates the tilt cylinder length of the tilt cylinder 30 on the basis of the detection results from the fourth stroke sensor 19.

In step S5, the bucket information computing unit 282A uses the law of cosines to calculate the inclination angle ω (see FIG. 14) based on the length M1 of the first line segment "a", the length M2 of the second line segment "b", and the tilt cylinder length.

In step S6, the bucket information computing unit 282A selects either the first computing equation Eq1 corresponding to the first disposition P1 or the second computing equation Eq2 corresponding to the second disposition P2 on the basis of the tilt cylinder disposition data.

In step S7, the bucket information computing unit 282A uses the selected computing equation (the first computing equation Eq1 or the second computing equation Eq2) to obtain the tilt angle δ by subtracting the reference angle ω' from the inclination angle ω.

The hydraulic excavator CM (example of the work vehicle) is provided with the tilt cylinder disposition data creating unit 284D and the bucket information computing unit 282A. The tilt cylinder disposition data creating unit 284D creates the tilt cylinder disposition data indicating that the disposition of the tilt cylinder 30 is in the first disposition P1 in which the bucket 8 rotates in the clockwise direction due to extension or the second disposition P2 in which the bucket 8 rotates in the clockwise direction due to contraction when viewing the bucket 8 from the vehicle body 1 side. The bucket information computing unit 282A selects either the first computing equation Eq1 corresponding to the first disposition P1 or the second computing equation Eq2 corresponding to the second disposition P2 on the basis of the tilt cylinder disposition data, and uses the selected computing equation to obtain the tilt angle δ of the bucket 8 based on the stroke length.

In this way, the tilt angle δ can be obtained easily by selecting the suitable computing equation according to whether the disposition of the tilt cylinder 30 is the first disposition P1 or the second disposition P2.

Other Exemplary Embodiments

Although an exemplary embodiment of the present invention has been described so far, the present invention is not limited to the above exemplary embodiments and various modifications may be made within the scope of the invention.

Figure 18:
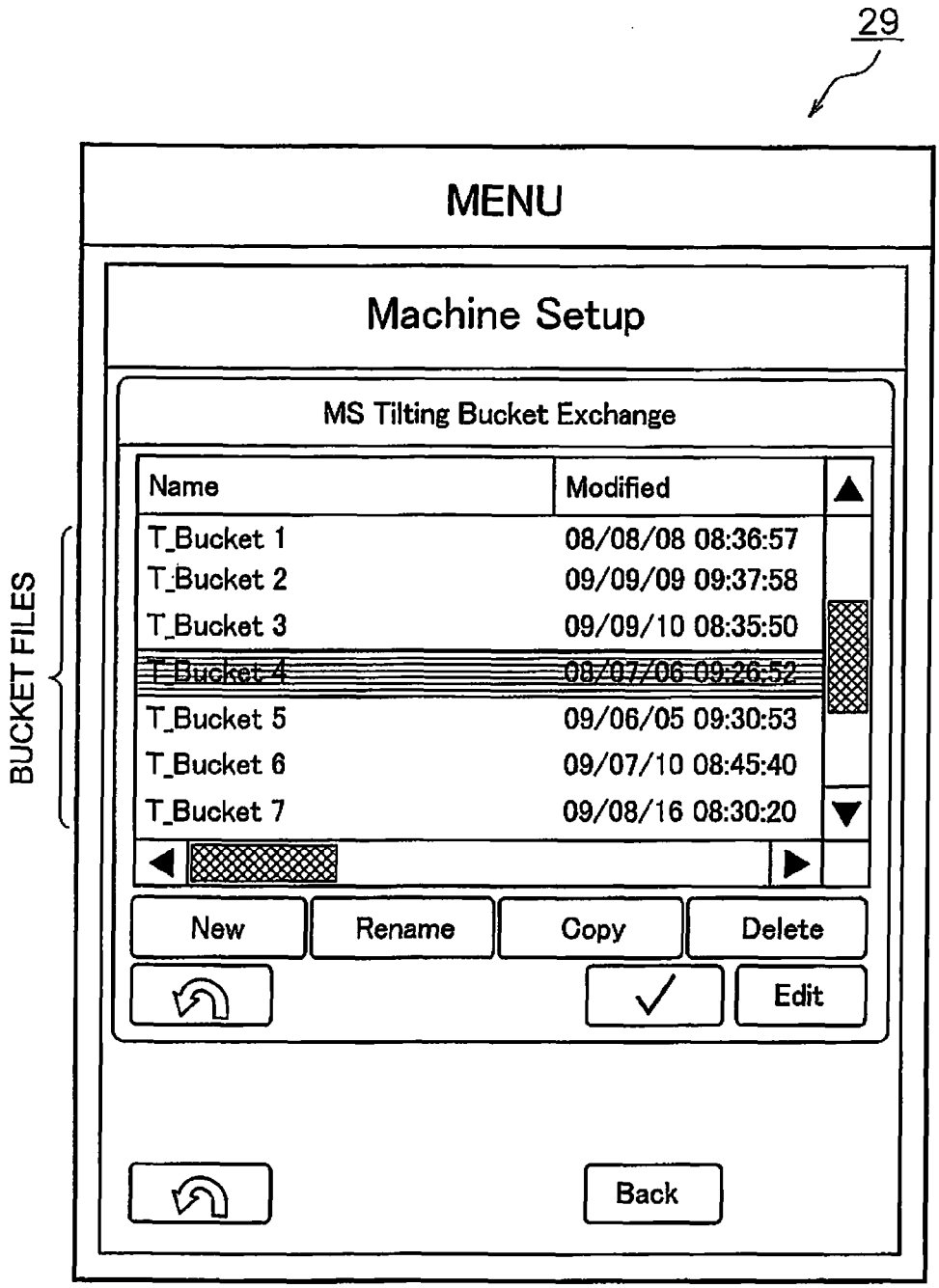
FIG. 18 is a view illustrating another dimension input screen of the display unit.

While the display controller 284C causes the selection screen of the tilt cylinder in the first disposition P1 or the tilt cylinder in the second disposition P2 to be displayed on the display unit 29 in the above exemplary embodiment, the present invention is not limited to this configuration. For example, the display controller 284C may cause a bucket file which indicates previously created tilt cylinder disposition data to be displayed on the display unit 29 as illustrated in FIG. 18. In this case, when a desired bucket file is selected by the operator via the input unit 36, the tilt cylinder disposition data creating unit 284D refers to the selected bucket file and retrieves the tilt cylinder disposition data included in the bucket file. The tilt cylinder disposition data creating unit 284D then transmits the retrieved tilt cylinder disposition data to the bucket information computing unit 282A.

While the rotation angle α of the boom 6, the rotation angle β of the arm 7, and the rotation angle γ of the bucket 8 are detected by stroke sensors in the above exemplary embodiment, the rotation angles may be detected by an angle detecting instrument such as a rotary encoder and the like.

While the hydraulic excavator CM is provided with the cab 4 in the above exemplary embodiment, the cab 4 may be omitted.

While an example of the hydraulic excavator CM is used as the work vehicle, the above exemplary embodiments may also be applied to another work vehicle such as a bulldozer or a wheel loader.

The present invention is useful in the field of work vehicles because the tilt angle can be obtained easily according to the present invention.

What is claimed is:

1. A work vehicle comprising:

a vehicle body;

a work implement having a bucket that is configured to rotate about a tilt axis;

a tilt cylinder configured to cause the bucket to rotate about the tilt axis;

a stroke length detecting unit configured to detect a stroke length of the tilt cylinder;

a tilt cylinder disposition data creating unit configured to create tilt cylinder disposition data which indicates whether a disposition of the tilt cylinder is a first disposition or a second disposition when viewing the bucket from the vehicle body side, the bucket disposed in the first disposition being rotated in the clockwise direction due to extension of the tilt cylinder, the bucket disposed in the second disposition being rotated in the clockwise direction due to contraction of the tilt cylinder; and a bucket information computing unit configured to obtain a tilt angle of the bucket based on the stroke length on the basis of the tilt cylinder disposition data.

2. The work vehicle according to claim 1, further comprising a display unit; and a display controller configured to cause a selection screen for selecting the first disposition or the second disposition to be displayed on the display unit, the tilt cylinder disposition data creating unit creating the tilt cylinder disposition data on the basis of a selection result from the selection screen.

3. The work vehicle according to claim 2, wherein the display controller is configured to cause a first pattern and a second pattern to be displayed on the display unit as the first disposition, when the bucket is disposed in the first pattern, a first end part of the tilt cylinder coupled to the bucket is positioned to the left of the tilt axis and a second end part provided opposite the first end part of the tilt cylinder is positioned below a coupling line that couples the tilt axis and the first end part when viewing the bucket from the vehicle body side, when the bucket is disposed in the second pattern, the first end part is positioned to the right of the tilt axis and the second end part is positioned above the coupling line when viewing the bucket from the vehicle body side, the display controller is configured to cause a third pattern and a fourth pattern to be displayed on the display unit as the second position, when the bucket is disposed in the third pattern, the first end part is positioned to the right of the tilt axis and the second end part is positioned below the coupling line when viewing the bucket from the vehicle body side, and when the bucket is disposed in the fourth pattern, the first end part is positioned to the left of the tilt axis and the second end part is positioned above the coupling line when viewing the bucket from the vehicle body side.

4. The work vehicle according to claim 3, wherein the bucket information computing unit is configured to select one of a first computing equation corresponding to the first disposition and a second computing equation corresponding to the second disposition on the basis of the tilt cylinder disposition data, the bucket information computing unit is configured to use a selected computing equation to obtain the tilt angle of the bucket based on the stroke length.

5. The work vehicle according to claim 3, wherein the display controller is configured to cause a bucket file which indicates the tilt cylinder disposition data to be displayed on the display unit, and the tilt cylinder disposition data creating unit is configured to obtain the tilt cylinder disposition data on the basis of a selection result of the bucket file.

6. The work vehicle according to claim 2, wherein the display controller is configured to cause a bucket file which indicates the tilt cylinder disposition data to be displayed on the display unit, and the tilt cylinder disposition data creating unit is configured to obtain the tilt cylinder disposition data on the basis of a selection result of the bucket file.

7. The work vehicle according to claim 2, wherein the bucket information computing unit is configured to select one of a first computing equation corresponding to the first disposition and a second computing equation corresponding to the second disposition on the basis of the tilt cylinder disposition data, the bucket information computing unit is configured to use a selected computing equation to obtain the tilt angle of the bucket based on the stroke length.

8. The work vehicle according to claim 1, wherein the bucket information computing unit is configured to select one of a first computing equation corresponding to the first disposition and a second computing equation corresponding to the second disposition on the basis of the tilt cylinder disposition data, the bucket information computing unit is configured to use a selected computing equation to obtain the tilt angle of the bucket based on the stroke length.

9. A method for obtaining a tilt angle, the method comprising:

a step detecting a stroke length of a tilt cylinder configured to cause a bucket to rotate about a tilt axis;

a step creating tilt cylinder disposition data which indicates whether a disposition of the tilt cylinder is a first disposition or a second disposition when viewing the bucket from a vehicle body side, the bucket disposed in the first disposition being rotated in the clockwise direction due to extension of the tilt cylinder, the bucket disposed in the second disposition being rotated in the clockwise direction due to contraction of the tilt cylinder, the bucket being disposed at the front of the vehicle body; and a step obtaining a tilt angle of the bucket based on the stroke length of the tilt cylinder on the basis of the tilt cylinder disposition data.

* * * * *